US007233322B2

(12) United States Patent
Takehara et al.

(10) Patent No.: US 7,233,322 B2
(45) Date of Patent: Jun. 19, 2007

(54) DISPLAY PANEL DRIVE CIRCUIT

(75) Inventors: Satoshi Takehara, Machida (JP); Yoshirou Yamaha, Hadano (JP)

(73) Assignee: Asahi Kasei Microsystems Co., Ltd., Tokyo (JP)

( * ) Notice: Subject to any disclaimer, the term of this patent is extended or adjusted under 35 U.S.C. 154(b) by 313 days.

(21) Appl. No.: 10/399,627

(22) PCT Filed: Aug. 22, 2002

(86) PCT No.: PCT/JP02/08471

§ 371 (c)(1),
(2), (4) Date: Apr. 18, 2003

(87) PCT Pub. No.: WO03/019516

PCT Pub. Date: Mar. 6, 2003

(65) Prior Publication Data

US 2004/0008074 A1 Jan. 15, 2004

(30) Foreign Application Priority Data

| | | | |
|---|---|---|---|
| Aug. 22, 2001 | (JP) | ..... | 2001-251430 |
| Aug. 22, 2001 | (JP) | ..... | 2001-251431 |
| Aug. 22, 2001 | (JP) | ..... | 2001-251432 |
| Aug. 24, 2001 | (JP) | ..... | 2001-255051 |
| Feb. 19, 2002 | (JP) | ..... | 2002-042284 |
| Mar. 19, 2002 | (JP) | ..... | 2002-077126 |

(51) Int. Cl.
*G09G 5/00* (2006.01)

(52) U.S. Cl. ..... 345/204; 345/90

(58) Field of Classification Search ..... 345/76, 345/82, 84, 85, 87, 90, 92
See application file for complete search history.

(56) References Cited

U.S. PATENT DOCUMENTS

| | | | | |
|---|---|---|---|---|
| 3,627,924 | A * | 12/1971 | Fleming et al. | 348/800 |
| 5,151,689 | A * | 9/1992 | Kabuto et al. | 345/103 |
| 6,020,865 | A | 2/2000 | Okuda et al. | |
| 6,061,046 | A * | 5/2000 | An | 345/98 |
| 6,380,917 | B2 * | 4/2002 | Matsueda et al. | 345/89 |
| 6,756,951 | B1 * | 6/2004 | Ishizuka et al. | 345/82 |
| 2002/0149556 | A1 * | 10/2002 | Matsueda | 345/98 |
| 2004/0113905 | A1 * | 6/2004 | Mori et al. | 345/204 |

FOREIGN PATENT DOCUMENTS

| | | |
|---|---|---|
| JP | 08340243 A | 12/1996 |
| JP | 2001-042827 | 2/2001 |
| JP | 2001042821 A | 2/2001 |

* cited by examiner

*Primary Examiner*—Richard Hjerpe
*Assistant Examiner*—Jean Lesperance
(74) *Attorney, Agent, or Firm*—Finnegan, Henderson, Farabow, Garrett & Dunner, L.L.P.

(57) ABSTRACT

To reduce degradation of image quality when constructing anode line drive circuits in a display panel drive circuit from a plurality of IC chips. Dummy drive output and proper drive output of an adjoining IC chip are switched in predetermined cycles and supplied to an anode line. This makes it possible to reduce variation in adjacent output currents among IC chips. Thus, it is possible to reduce luminance differences in display areas caused by differences in current driving capacity among IC chips and reduce degradation of image quality when an anode line drive circuit is constructed from a plurality of IC chips.

13 Claims, 31 Drawing Sheets

(a)

(b)

(c)

| Output | Switch | | | |
|---|---|---|---|---|
| r1 | s11 | s12 | s13 | s14 |
| r2 | s21 | s22 | s23 | s24 |
| r3 | s31 | s32 | s33 | s34 |
| r4 | s41 | s42 | s43 | s44 |

(d)

DISPLAY PANEL DRIVE CIRCUIT

TECHNICAL FIELD

The present invention relates to a drive circuit for a display panel. More particularly, it relates to a drive circuit for a display panel which consists of self-luminous elements such as electroluminescent elements. Electroluminescent elements include organic electroluminescent elements and inorganic electroluminescent elements. The present invention is suitable for both of them.

BACKGROUND ART

Organic electroluminescent (hereinafter abbreviated to EL) elements are known as self-luminous elements used to implement thin, low-power consuming display devices. A display device and its drive circuit using EL elements are described in Japanese Patent Laid-Open No. 2001-42821.

FIG. 1 shows schematic configuration of this EL element. As shown in the figure, the EL element is made by laminating a transparent substrate 100 such as a glass substrate on which a transparent electrode 101 is formed; at least one organic functional layer 102 composed of an electron transport layer, luminescent layer, and hole transport layer; and a metal electrode 103.

FIG. 2 is an equivalent circuit diagram showing characteristics of the EL element electrically. The EL element shown in the figure can be replaced by a capacitive component C and a component E which has properties of a diode and is coupled in parallel with the capacitive component.

If a direct current is passed between the transparent electrode 101 and metal electrode 103 with a positive voltage applied to the anode (+pole) of the transparent electrode 101 and a negative voltage applied to the cathode (−pole) of the metal electrode 103, electric charge is accumulated in the capacitive component C. When quantity of the charge exceeds the level of an inherent barrier voltage or luminescence threshold voltage of the EL element, a current starts to flow from an electrode (the anode of the diode component E) to the organic functional layer which carries the luminescent layer and the organic functional layer 102 (see FIG. 1) emits light with intensity proportional to the current.

FIG. 3 shows schematic configuration of an EL display device which displays images using a EL display panel consisting of a plurality of the EL elements arranged in a matrix. In the figure, cathode lines (lines connected to the metal electrode) $B_1$ to $B_n$ carrying a first display line to n-th display line, respectively, and m anode lines (lines connected to the transparent electrode) $A_1$ to $A_m$ intersecting the cathode lines $B_1$ to $B_n$ are formed on an ELDP 10, i.e., an EL display panel. EL elements $E_{11}$ to $E_{nm}$ with the above described configuration are formed at respective intersections (n×m intersections) of the cathode lines $B_1$ to $B_n$ and anode lines $A_1$ to $A_m$. In addition, each of the EL elements $E_{11}$ to $E_{nm}$ corresponds to each pixel of the ELDP 10.

A luminescence control circuit 1 converts one screen (n rows×m columns) of input image data into pixel data $D_{11}$ to $D_{nm}$ corresponding to the pixels of the ELDP 10, i.e., the EL elements $E_{11}$ to $E_{nm}$, and supplies sequentially them row by row to an anode line drive circuit 2 as shown in FIG. 4. For example, pixel data $D_{11}$ to $D_{1m}$ consist of m data bits which specify whether the respective EL elements $E_{11}$ to $E_{1m}$ belonging to the first display line of the ELDP 10 should emit light. Each of them indicates "luminescence" when it is at logic "1," and "non-luminescence" when it is at logic "0."

The luminescence control circuit 1 supplies a cathode line selection control signal to a cathode line drive circuit 3 in synchronization with row-by-row supply of pixel data as shown in FIG. 4 to scan the first display line to n-th display line of the ELDP 10 in sequence. First, the anode line drive circuit 2 extracts all the data bits with a logic "1" which specifies "luminescence" from the m data bits in the pixel data group. Then, it selects all the anode lines which belong to the "columns" corresponding to the extracted data bits from the anode lines $A_1$ to $A_m$, and connects a constant current source and supplies a predetermined pixel drive current i only to the selected anode lines.

The cathode line drive circuit 3 selects the cathode line—only one cathode line at a time—which corresponds to the display line indicated by the cathode line selection control signal from among the cathode lines $B_1$ to $B_n$ and connects it to ground potential while applying a predetermined high potential $V_{cc}$ to each of the other cathode lines. The high potential $V_{cc}$ is set approximately equal to the voltage (voltage determined based on quantity of charge of a parasitic capacitance C) across a given EL element which is emitting light of desired luminance.

In this case, a light emission drive current flows between the "columns" connected to the constant current source by the anode line drive circuit 2 and the display lines set to the ground potential by the cathode line drive circuit 3. The EL elements formed at the intersections of the display lines and "columns" emit light according to the light emission drive current. On the other hand, since no current flows between the display lines set to the high potential $V_{cc}$ by the cathode line drive circuit 3 and "columns" connected to the constant current source, the EL elements formed at their intersections remain non-luminescent.

As the above operations are performed based on the pixel data $D_{11}$ to $D_{1m}$, $D_{21}$ to $D_{2m}$, . . . , and $D_{n1}$ to $D_{nm}$, a screen of the ELDP 10 displays one field of light emission pattern, i.e., an image, according to the input image data.

By the way, recently, for implementation of big-screen display panels, it has become necessary to improve screen resolution by increasing the number of display lines, i.e., the cathode lines B, as well as the number of anode lines A. Thus as the number of cathode lines B and anode lines A increase, so do the scale of the anode line drive circuit 2 and the cathode line drive circuit 3. Therefore, it is feared that when both the circuits are implemented as integrated circuits, increased chip area will result in lower yields. In this connection, it is conceivable to construct the anode line drive circuit 2 and the cathode line drive circuit 3 each from a plurality of IC chips.

For example, it is conceivable to construct the anode line drive circuit 2 from two IC chips 2*a* and 2*b* as shown in FIG. 5. When the anode line drive circuit 2 is constructed from the two IC chips 2*a* and 2*b* in this way, anode lines $A_1$ to $A_n$ will be driven by the IC chip 2*a* and anode lines $A_{N+1}$ to $A_m$ will be driven by the IC chip 2*b* as shown in FIG. 6. Incidentally, in FIG. 6, current outputs to the pixel elements, i.e., channel numbers for drive outputs, are denoted by "1" to "N−1," "N," "N+1," "N+2" to "m."

However, if the anode line drive circuit 2 is constructed from a plurality of IC chips as shown in FIG. 6, manufacturing variations and the like may cause differences among IC chips in the value of the light emission drive current to be supplied to the anode lines. Therefore the differences in the light emission drive current will produce areas with different luminance on the screen of the ELDP 10 and the stepwise change will consequently impair image quality especially on boundaries between these areas.

A technique for solving this problem is described in Japanese Patent Laid-Open No. 2001-42827.

FIG. 7 shows schematic configuration of an EL display device described in the Japanese patent. In the figure, the IC chip 2*a* functions as a first anode line drive circuit 210 while the IC chip 2*b* functions as a second anode line drive circuit 220. Cathode lines (lines connected to a metal electrode) $B_1$ to $B_n$ carrying a first display line to n-th display line, respectively, and 2m anode lines (lines connected to a transparent electrode) $A_1$ to $A_{2m}$ intersecting the cathode lines $B_1$ to $B_n$ are formed on an ELDP 10', i.e., an EL display panel. EL elements $E_{1,1}$ to $E_{n,2m}$ with the configuration shown in FIG. 1 are formed at respective intersections of the cathode lines $B_1$ to $B_n$ and anode lines $A_1$ to $A_{2m}$. Each of the EL elements $E_{1,1}$ to $E_{n,2m}$ corresponds to each pixel of the ELDP 10'.

A luminescence control circuit 1' supplies a cathode line selection control signal to a cathode line drive circuit 3 as shown in FIG. 8 to scan the first display line to n-th display line of the ELDP 10' in sequence. The cathode line drive circuit 3 selects the cathode line—only one cathode line at a time—which corresponds to the display line indicated by the cathode line selection control signal from among the cathode lines $B_1$ to $B_n$ of the ELDP 10' and connects it to ground potential while applying a predetermined high potential $V_{cc}$ to each of the other cathode lines.

Also, the luminescence control circuit 1' converts one screen (n rows×2m columns) of input image data into pixel data $D_{1,1}$ to $D_{n,2m}$ corresponding to the pixels of the ELDP 10', i.e., the EL elements $E_{1,1}$ to $E_{n,2m}$, and divides the pixel data into those belonging to the first to m-th columns and those belonging to the (m+1)-th to 2m-th columns. Then, the luminescence control circuit 1' groups the pixel data belonging to the first to m-th columns by display line and supplies the resulting pixel data $D_{1,1}$ to $D_{1,m}$, $D_{2,1}$ to $D_{2,m}$, $D_{3,1}$ to $D_{3,m}$, . . . , and $D_{n,1}$ to $D_{n,m}$ one after another as first drive data $GA_{1-m}$ to the first anode line drive circuit 210 as shown in FIG. 8. At the same time it groups the pixel data belonging to the (m+1)-th to 2m-th columns by display line and supplies the resulting pixel data $D_{1,m+1}$to $D_{1,2m}$, $D_{2,m+1}$ to $D_{2,2m}$, $D_{3,m+1}$ to $D_{3,2m}$, . . . , and $D_{n,m+1}$ to $D_{n,2m}$ one after another as second drive data $GB_{1-m}$ to the second anode line drive circuit 220 as shown in FIG. 8.

The first drive data $GA_{1-m}$ and second drive data $GB_{1-m}$ are supplied one after another to the first anode line drive circuit 210 and second anode line drive circuit 220, respectively, in synchronization with the scan line selection control signal as shown in FIG. 8. The first drive data $GA_{1-m}$ here consist of m data bits which specify whether the respective m EL elements belonging to the first to m-th columns of each display line of the ELDP 10' should emit light. Similarly, the second drive data $GB_{1-m}$ consist of m data bits which specify whether the respective m EL elements belonging to the (m+1)-th to 2m-th columns of each display line of the ELDP 10' should emit light. For example, each of the data bits indicates luminescence when it is at logic "1," and non-luminescence when it is at logic "0."

FIG. 9 shows internal configuration of drive circuits, namely, the first anode line drive circuit 210 and second anode line drive circuit 220. The first anode line drive circuit 210 and second anode line drive circuit 220 are constructed in different two IC chips (see FIG. 5). In FIG. 9, the first anode line drive circuit 210 comprises a reference current control circuit RC, a control current output circuit CO, and a switch block SB as well as transistors $Q_1$ to $Q_m$ and resistors $R_1$ to $R_m$ serving as m current drive sources.

The emitter of a transistor $Q_b$ in the reference current control circuit RC is connected with a predetermined pixel drive voltage $V_{HE}$ via a resistor $R_r$ while the base and collector are connected with the collector of a transistor $Q_a$. A predetermined reference voltage $V_{REF}$ and emitter potential of the transistor $Q_a$ are fed into an operational amplifier OP. Output potential of the operational amplifier OP is fed into the base of the transistor $Q_a$. The emitter of the transistor $Q_a$ is connected to ground potential via a resistor $R_p$. With the above configuration, a reference current $I_{REF}$ ($=V_{REF}/R_p$) flows between the collector and emitter of the transistor $Q_a$.

The pixel drive voltage $V_{HE}$ is applied to the emitters of the transistors $Q_1$ to $Q_m$ via the resistors $R_1$ to $R_m$, respectively. Besides, the bases of the transistors are connected with the base of the transistor $Q_b$. The resistor $R_r$ and resistors $R_1$ to $R_m$ have the same resistance value and the transistors $Q_1$ to $Q_m$, $Q_a$ and $Q_b$ have the same characteristics. Consequently, the reference current control circuit RC and transistors $Q_1$ to $Q_m$ compose a current mirror circuit (hereinafter referred to as a current mirror). Thus, a light emission drive current i with the same current value as the reference current $I_{REF}$ is output, flowing between the emitter and collector of each of the transistors $Q_1$ to $Q_m$ by mirror effect.

The switch block SB contains m switching elements $S_1$ to $S_m$ which conduct the light emission drive current i outputted from the transistors $Q_1$ to $Q_m$ to output terminals $X_1$ to $X_m$, respectively. In the switch block SB of the first anode line drive circuit 210, the switching elements $S_1$ to $S_m$ are turned on and off separately according to the logical state of the respective first drive data $GA_1$ to $GA_m$ supplied from the luminescence control circuit 1'.

For example, when the first drive data $GA_1$ is at logic "0," the switching element $S_1$ is OFF. On the other hand, when the first drive data $GA_1$ is at logic "1," the switching element $S_1$ turns on to conduct the light emission drive current i supplied from the transistor $Q_1$ to the output terminal $X_1$. Also, when the first drive data $GA_m$ is at logic "0," the switching element $S_m$ is OFF. On the other hand, when the first drive data $GA_m$ is at logic "1," the switching element $S_m$ turns on to conduct the light emission drive current i supplied from the transistor $Q_m$ to the output terminal $X_m$. In this way, the light emission drive current i outputted from the transistors $Q_1$ to $Q_m$ is supplied to the respective anode lines $A_1$ to $A_m$ of the ELDP 10' via the respective output terminals $X_1$ to $X_m$ as shown in FIG. 7.

A pixel drive voltage $V_{BE}$ is applied to the emitter of a transistor $Q_0$ in the control current output circuit CO via a resistor $R_0$. Besides, the base of the transistor $Q_0$ is connected with the base of the transistor $Q_b$ in the reference current control circuit RC. The resistor $R_0$ has the same resistance value as the resistor $R_r$ in the reference current control circuit RC. And the transistor $Q_0$ has the same characteristics as the transistors $Q_a$ and $Q_b$ in the reference current control circuit RC. Consequently, the transistor $Q_0$ in the control current output circuit CO and the reference current control circuit RC compose a current mirror. Thus, the same amount of current as the reference current $I_{REF}$ flows between the collector and emitter of each of the transistor $Q_0$. The control current output circuit CO supplies this current as control current ic to an input terminal $I_{in}$ of the second anode line drive circuit 22 via an output terminal $I_{out}$. In other words, the same current as the light emission drive current i supplied to the anode lines $A_1$ to $A_m$ of the ELDP 10' by the first anode line drive circuit 210 is supplied as the control current ic to the second anode line drive circuit 220.

The second anode line drive circuit 220 comprises a drive current control circuit CC and a switch block SB as well as transistors $Q_1$ to $Q_m$ and resistors $R_1$ to $R_m$ serving as m current drive sources. The collector and base of a transistor $Q_c$ in the drive current control circuit CC are connected with the input terminal $I_{in}$ while the emitter is connected to the ground potential via a resistor $R_{Q1}$. Consequently, the control current ic outputted from the first anode line drive circuit 210 flows between the collector and emitter of the transistor $Q_c$ via the input terminal $I_{in}$.

The pixel drive voltage $V_{BE}$ is supplied to the emitter of a transistor $Q_e$ in the drive current control circuit CC via a resistor $R_S$. Besides, the base and collector of the transistor $Q_e$ is connected with the collector of a transistor $Q_d$. The base of the transistor $Q_d$ is connected with the collector and base of the transistor $Q_c$ while the emitter is connected to the ground potential via a resistor $R_{Q2}$. The transistors $Q_c$, $Q_d$, and $Q_e$ have the same characteristics as the transistor $Q_0$ in the first anode line drive circuit 210 while the resistor $R_S$ has the same resistance value as the resistor $R_0$ in the first anode line drive circuit 210. Consequently, the same current as the control current ic outputted from the first anode line drive circuit 210 flows between the collector and emitter of the transistor $Q_d$.

The pixel drive voltage $V_{BE}$ is supplied to the emitters of the transistors $Q_1$ to $Q_m$ in the second anode line drive circuit 220 via the resistors $R_1$ to $R_m$, respectively. Besides, the bases of the transistors are connected with the base of the transistor $Q_e$. The resistor $R_S$ and resistors $R_1$ to $R_m$ have the same resistance value and the transistors $Q_1$ to $Q_m$, $Q_d$, and $Q_e$ have the same characteristics. Consequently, the drive current control circuit CC and transistors $Q_1$ to $Q_m$ compose a current mirror. Thus, the light emission drive current i equal in amount to the control current ic supplied from the first anode line drive circuit 210 is output, flowing between the emitter and collector of each of the transistors $Q_1$ to $Q_m$. The amount of the light emission drive current i outputted from the transistors $Q_1$ to $Q_m$ in the second anode line drive circuit 220 is adjusted by the drive current control circuit CC so that it will be equal to that of the light emission drive current outputted from the first anode line drive circuit 210.

The switch block SB contains m switching elements $S_1$ to $S_m$, which conduct the light emission drive current i outputted from the transistors $Q_1$ to $Q_m$ to the output terminals $X_1$ to $X_m$, respectively. In the switch block SB of the second anode line drive circuit 220, the switching elements $S_1$ to $S_m$ are turned on and off separately according to the logical state of the respective second drive data $GB_1$ to $GB_m$ supplied from the luminescence control circuit 1'.

For example, when the second drive data $GB_1$ is at logic "0," the switching element $S_1$ is OFF. On the other hand, when the second drive data $GB_1$ is at logic "1," the switching element $S_1$ turns on to conduct the light emission drive current i supplied from the transistor $Q_1$ to the output terminal $X_1$. Also, when the second drive data $GB_m$ is at logic "0," the switching element $S_m$ is OFF. On the other hand, when the second drive data $GB_m$ is at logic "1," the switching element $S_m$ turns on to conduct the light emission drive current i supplied from the transistor $Q_m$ to the output terminal $X_m$. In this way, the light emission drive current i outputted from the transistors $Q_1$ to $Q_m$ in the second anode line drive circuit 220 is supplied to the respective anode lines $A_{m+1}$ to $A_{2m}$ of the ELDP 10' via the respective output terminals $X_1$ to $X_m$ as shown in FIG. 7.

As described above, with the drive circuit described in the above patent, in addition to the current source (transistors $Q_1$ to $Q_m$) for generating the light emission drive current, the anode line drive circuits contain the drive current control circuit CC for maintaining the amount of the light emission drive current at a level appropriate to inputted control current and the control current output circuit CO for outputting the light emission drive current itself as control current. When the anode lines of a display panel are driven by a plurality of anode line drive circuits each constructed in a separate IC chip, the first anode line drive circuit controls the amount of light emission drive current to be output based on the light emission drive current actually output by the second anode line drive circuit. Thus, even if there are variations in characteristics between the IC chips (serving as the anode line drive circuits), the amounts of light emission drive currents outputted from the individual IC chips will be approximately equal, producing uniform emission luminance on the display panel.

The technique described in the above patent uses a current mirror to transfer the reference current from the first anode line drive circuit 210 consisting of an IC chip to the second anode line drive circuit 220 consisting of another IC chip. Thus, any current variation in the current mirror will cause variation in output current between the IC chips, failing to provide uniform emission luminance on the display panel.

FIG. 10 shows a current mirror composed of N+1 MOS (Metal Oxide Semiconductor) transistors.

As shown in FIG. 10, the current mirror circuit comprises a current source $I_{org}$ as well as the N+1 MOS transistors $P_{OUT0}$, $P_{OUT1}$, . . . , and $P_{OUTN}$. Of the N+1 MOS transistors, one MOS transistor $P_{OUT0}$ constitutes a reference current source for the current mirror in conjunction with the current source $I_{org}$. The output currents from the other N MOS transistors are used as drive output for the display panel. In this example, the outputs from the other N MOS transistors $P_{OUT1}$ to $P_{OUTN}$ are merged into an output current $I_{out}$ for use as drive output.

Assume that all the N+1 MOS transistors $P_{OUT0}$ to $P_{OUTN}$ have the same size. Then, the current ratio, i.e., the ratio of the current derived by the MOS transistor $P_{OUT0}$ to the current derived by the other N MOS transistors $P_{OUT1}$ to $P_{OUTN}$, is 1:N. The output current $I_{out}$ at this time is given by $$I_{out}=N\times I_{org}$$

Generally, current variation ΔI depends on the size of MOS transistors. When the size of MOS transistors is small, the current variation ΔI is large. Conversely, when the size of MOS transistors is large, the current variation ΔI is small.

In the case of MOS transistors used to drive display panels, MOS transistors which correspond to the second proportional "N" in the above current ratio "1:N" are far larger in size than the MOS transistor which corresponds to the first proportional "1." For example, N>10. Thus, the current variation ΔI is mostly attributable to a variation in current generated from the MOS transistor $P_{OUT0}$ which corresponds to the first proportional "1."

It is also conceivable to reduce the current ratio of the current mirror, for example, to 2:N/2 or 3:N/3. This will reduce the current variation ΔI. However, since there are as many channels as there are anode lines, the amount of current of the current source $I_{org}$ must be increased, resulting in increased power consumption of the IC chips.

A current DAC (digital analog converter) circuit is sometimes used as the constant current source for the anode line drive circuit 2 described above. This requires a current DAC circuit with as many channels as there are anode lines. Configuration of such a current DAC circuit is shown in FIG. 11.

The current DAC circuit shown in FIG. 11 can be divided into a BIAS portion B and a DAC portion D. A transistor which acts as the BIAS portion B is connected directly to a reference current source $I_{ref}$ for the current mirror. On the other hand, transistors other than the one which acts as the BIAS portion B operate as a DAC circuit to generate the output current $I_{out}$ which constitutes a drive signal to be supplied to pixels. This configuration makes it possible to vary data signals (D0 to Dn) sent to the DAC portion D and thereby vary the current mirror ratio and generate the output current $I_{out}$ which constitutes analog data.

A multi-channel current DAC circuit can be configured to have a plurality of BIAS portions and a plurality of DAC portions or to have a single BIAS portion and a plurality of DAC portions.

A circuit shown in FIG. 12 is configured to have a plurality of BIAS portions and a plurality of DAC portions. Each BIAS portion gives a bias signal to a corresponding DAC portion. In this case, the circuit, in which the BIAS portions and DAC portions are located in close proximity to each other, has the advantage of not being affected by a tendency of $V_{th}$ in the IC chip or voltage drops due to long wiring.

However, since a current mirror circuit exists on each channel, shifts in drain voltages of transistors will cause systematic shifts in current values. This is because the drain current given by the following equation is shifted slightly by the effect of λ when the drain voltage varies even if the transistors are saturated.

$$I_{DS}=K(V_{GS}-V_{th})^2\cdot(1+\lambda V_{DS})$$

Also, random current variation ΔI is generated which depends on transistor size and $V_{on}$. Thus, this configuration has the disadvantage that the output current $I_{out}$ of each channel varies. The variation in this case constitutes current variation between adjacent channels.

On the other hand, a circuit shown in FIG. 13 is configured to have a single BIAS portion and a plurality of DAC portions. Thus, the single BIAS portion supplies bias signals to the plurality of DAC portions. In this case since a current mirror circuit is common to all the channels, this configuration can suppress the systematic shift in current value caused by shift in drain voltage of transistors and the random variation ΔI in current values which depend on the size of transistors and Von. This is because the number of times of mirroring is reduced. Thus, this configuration has the advantage that the variation in the output current $I_{out}$ of each channel is suppressed.

However, the circuit, in which the distance between the BIAS portion and DAC portions varies among channels, has the disadvantage of being affected by a tendency of $V_{th}$ in the IC chip or voltage drops due to long wiring. The variation in this case constitutes trended variation in output currents in the IC chip.

As described above, each of the circuit configurations in FIGS. 12 and 13 has its own advantages and disadvantages. When adopting a circuit configuration with a single BIAS portion and a plurality of DAC portions and with small variations between adjacent channels as shown in FIG. 13, in particular, it is desired to reduce the trended variation which can occur in the output currents in the IC chip.

A first object of the present invention is to reduce degradation of image quality when constructing anode line drive circuits in a display panel drive circuit from a plurality of IC chips.

A second object of the present invention is to reduce current variation which occurs in a current mirror in anode line drive circuits and eliminate variation in reference voltage among a plurality of IC chips.

A third object of the present invention is to reduce current variation in a display panel drive circuit without increasing power consumption of IC chips.

A fourth object of the present invention is to reduce trended variation in output currents in the IC chip in a display panel drive circuit as well as to reduce variation between adjacent channels by implementing an accurate DAC circuit.

DISCLOSURE OF THE INVENTION

A display panel drive circuit according to the present invention supplies current to a plurality of drive line groups for driving a plurality of pixel elements which compose a display panel, characterized in that current which flows through each of the plurality of drive line groups is switched in predetermined cycles. The plurality of pixel elements which compose the display panel are electroluminescent elements.

The plurality of drive line groups may be constructed in a plurality of different IC chips and each of the plurality of IC chips may comprise a plurality of drive current supplying means for supplying a drive current to each of the plurality of IC chips and switching means for switching correspondence between the plurality of IC chips and the plurality of drive current supplying means in predetermined cycles. The display panel drive circuit is characterized in that the switching means is formed in the IC chips.

Of the plurality of drive line groups, first and second drive line groups may be provided in a first and second IC chips, respectively; and the switching means may receive a first drive output belonging to a drive output group of the first IC chip and a second drive output belonging to a drive output group of the second IC chip and supply them to a drive line which belongs to the first drive line group and adjoins the second drive line group by switching between them in predetermined cycles.

The second IC chip may have a dummy drive output which does not correspond to any of the drive lines composing the second drive line group and the dummy drive output may be fed as the second drive output into the switching means.

The display panel drive circuit may further comprise a reference current source shared by the plurality of drive current supplying means, with the reference current source and drive current supplying means composing a current mirror circuit.

The plurality of IC chips are three or more in number and the correspondence between the drive current supplying means and the IC chips may be switched in rotation in predetermined cycles.

The display panel drive circuit may comprise a plurality of reference current sources each of which generates a reference current; a plurality of drive current generating means for forming a current mirror circuit in conjunction with the plurality of drive current sources to generate current and driving the first and second drive line groups; and switching means for switching correspondence between the plurality of reference current sources and the plurality of drive current generating means in predetermined cycles. The plurality of reference current sources and the plurality of drive current generating means may be contained in a plurality of IC chips.

The switching means may switch electrical connection between the plurality of reference current sources and plurality of IC chips using pulses with a duty ratio of 1/N, where N is the number of IC chips.

The display panel drive circuit may comprise a plurality of digital-to-analog converter portions and a single biasing portion which gives bias signals to the digital-to-analog converter portions; supply a plurality of output currents derived from the plurality of digital-to-analog converter portions to the plurality of drive line groups; and comprise switching means for switching correspondence between the plurality of digital-to-analog converter portions and the plurality of derived output currents in a time-divided manner. The switching means may comprise a plurality of switches corresponding to the plurality of digital-to-analog converter portions and switch correspondence between the plurality of digital-to-analog converter portions and the plurality of derived output currents in a time-divided manner by operating the plurality of switches in sequence.

Another display panel drive circuit according to the present invention supplies current to a plurality of IC chips and drives the display panel by the supplied current, characterized by comprising drive current supplying means for supplying drive current to each of the plurality of IC chips; and switching means for switching correspondence between the IC chips and the drive current supplying means in predetermined cycles.

The display panel drive circuit may further comprise a reference current source shared by the drive current supplying means, with the reference current source and drive current supplying means composing a current mirror circuit.

The plurality of IC chips are three or more in number and the correspondence between the drive current supplying sources and the IC chips may be switched in rotation in predetermined cycles.

The display panel may be composed of a plurality of electroluminescent elements driven by drive output produced by the respective IC chips.

Another display panel drive circuit according to the present invention comprises first and second IC chips and supplies drive output groups from the first and second IC chips to first and second IC drive line groups for driving a plurality of pixel elements which compose the display panel, characterized by comprising a switching circuit which receives a first drive output belonging to a drive output group of the first IC chip and a second drive output belonging to a drive output group of the second IC chip and supplies them to a drive line which belongs to the first drive line group and adjoins the second drive line group by switching between them in predetermined cycles. The switching means may be formed in the first IC chips.

The second IC chip may have a dummy drive output which does not correspond to any of the drive lines composing the second drive line group and the dummy drive output may be fed as the second drive output into the switching means.

The plurality of pixel elements which compose the display panel are characterized by being electroluminescent elements.

Another display panel drive circuit according to the present invention provides current for driving a plurality of pixel elements which compose a display panel, comprising: one transistor which serves as a reference current source; N transistors (N is a natural number) which compose a current mirror circuit in conjunction with the one transistor; and switching means for selecting a transistor to serve as a reference current source from the N+1 transistors and switching to it periodically, characterized in that outputs from the remaining N transistors are derived as drive output for the display panel. The outputs from the remaining N transistors may be merged into one when derived as drive output for the display panel.

The display panel may be composed of a plurality of electroluminescent elements driven by the drive output.

Another display panel drive circuit according to the present invention comprises a plurality of reference current sources each of which generates a reference current; and a plurality of drive current generating means which generate current by mirroring the plurality of reference current sources and provide current for driving a plurality of pixel elements which compose a display panel, characterized in that the drive current generating means are contained in a plurality of IC chips and comprise switching means for switching correspondence between the plurality of reference current sources and the plurality of IC chips in predetermined cycles. The switching means switches electrical connection between the plurality of reference current sources and plurality of IC chips using pulses with a duty ratio of 1/N, where N is the number of IC chips.

The display panel may be composed of electroluminescent elements driven by drive output produced by the respective IC chips.

Another display panel drive circuit according to the present invention is characterized in that: at least one of a plurality of transistors supplies bias signals being connected directly with a reference current source for a current mirror while the other transistors operate as a circuit which generates drive signals to be supplied to pixels using the bias signals; and the display panel drive circuit, characterized in that it comprises a switching means for switching sequentially, in a time-divided manner, the transistor which supplies the bias signals. The switching means comprises a plurality of switches corresponding to each of the plurality of transistors;

at least one of the plurality of switches operates so that the corresponding transistor is connected with the reference current source to act as a mirror source of a current mirror circuit; and all the other switches are operated so that their corresponding transistors conduct to act as circuits for generating the drive signals.

Another display panel drive circuit according to the present invention is characterized in that it: comprises a plurality of digital-to-analog converter portions and a single biasing portion which gives bias signals to the digital-to-analog converter portions; supplies a plurality of output currents derived from the plurality of digital-to-analog converter portions to pixels to drive a display panel; and comprises switching means for switching correspondence between the plurality of digital-to-analog converter portions and the plurality of derived output currents in a time-divided manner. The switching means may be characterized in that it comprises a plurality of switches corresponding to the plurality of digital-to-analog converter portions and switch correspondence between the plurality of digital-to-analog converter portions and the plurality of derived output currents in a time-divided manner by operating the plurality of switches in sequence.

BRIEF DESCRIPTION OF THE DRAWINGS

FIG. 17(*b*) is a timing chart showing operations of various parts shown in FIG. 17(*a*);

FIG. 19(*b*) is a timing chart showing the timing to switch among three drive current sources in rotation among three IC chips;

FIG. 29(*b*) is a waveform diagram showing output signals of the four-stage ring counter;

FIG. 29(*c*) is a diagram showing destinations of the output signals of the four-stage ring counter;

FIG. 29(*d*) is a diagram showing a configuration example of a switch;

BEST MODE FOR CARRYING OUT THE INVENTION

Figure 1:
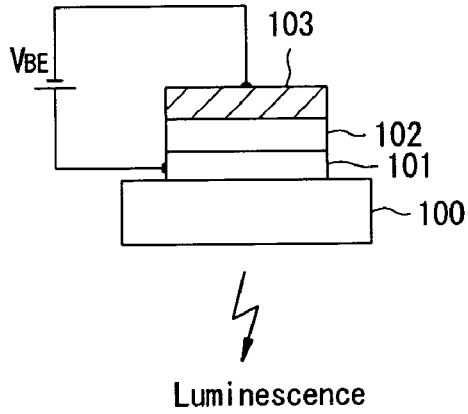
FIG. 1 is a schematic configuration of an EL element.
Figure 2:
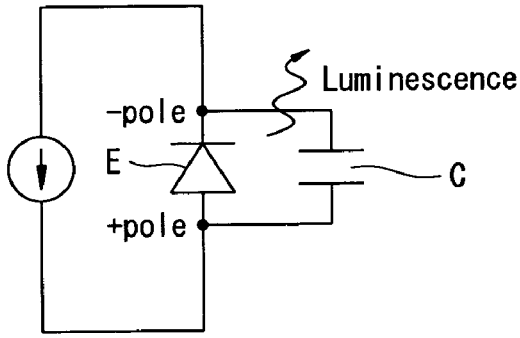
FIG. 2 is an equivalent circuit diagram showing characteristics of the EL element electrically.
Figure 3:
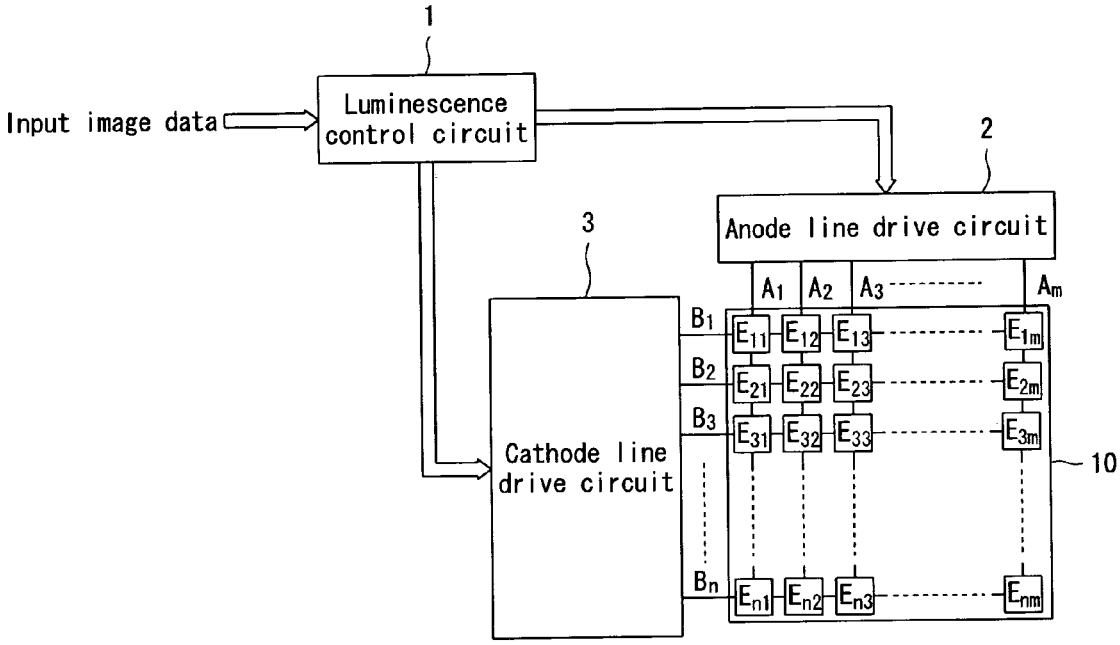
FIG. 3 is a schematic configuration of an EL display device which displays images using a display panel consisting a plurality of the EL elements arranged in a matrix.
Figure 4:
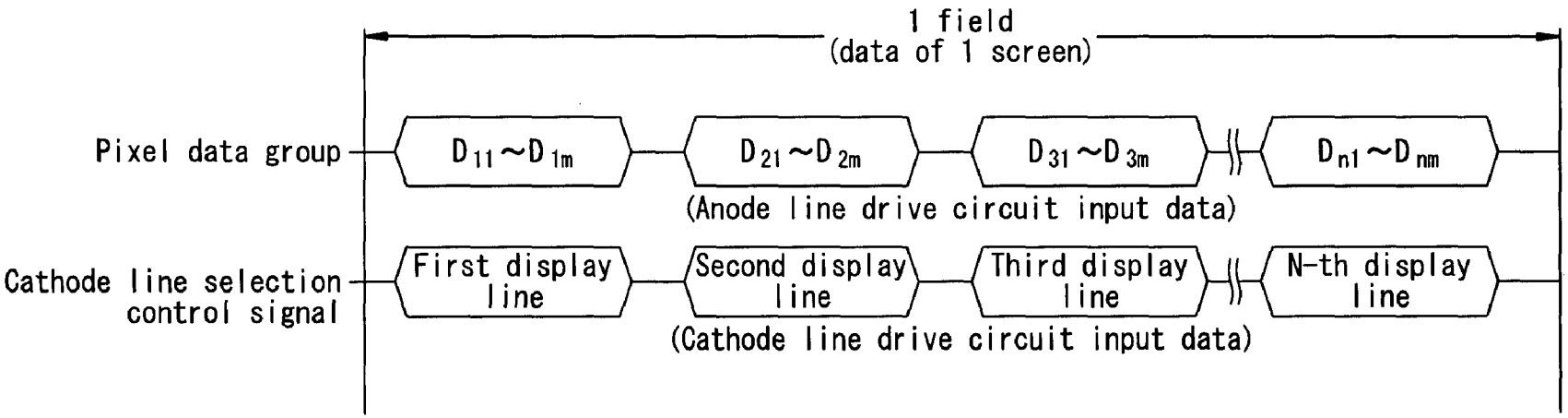
FIG. 4 is a diagram showing the timing for supplying pixel data and a scan line selection signal.
Figure 5:
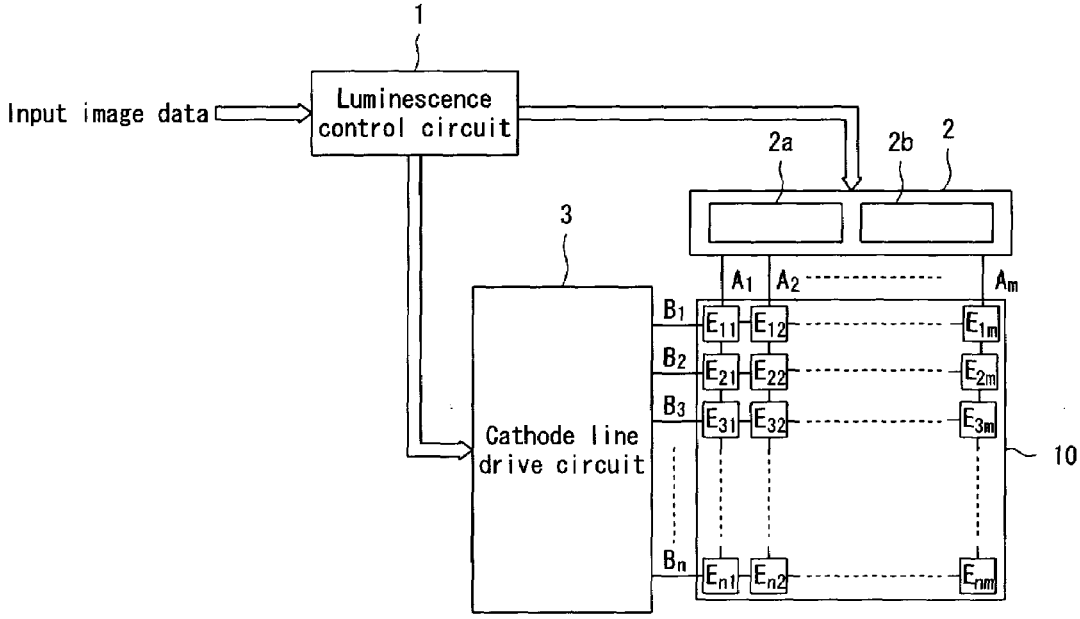
FIG. 5 is a diagram showing an anode line drive circuit constructed from two IC chips.
Figure 6:
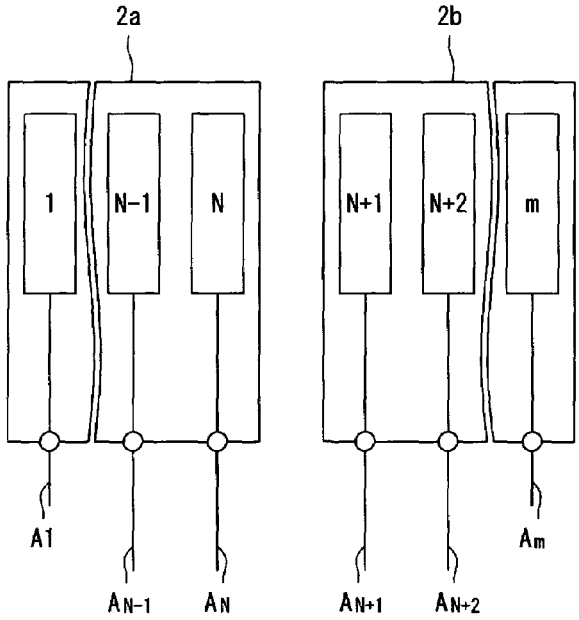
FIG. 6 is a diagram showing correspondence between drive outputs of an anode line drive circuit and anode lines.

Next, embodiments of the present invention will be described with reference to the drawings. In the following description, equivalent parts in different drawings are denoted by the same reference numerals/characters.

Figure 14:
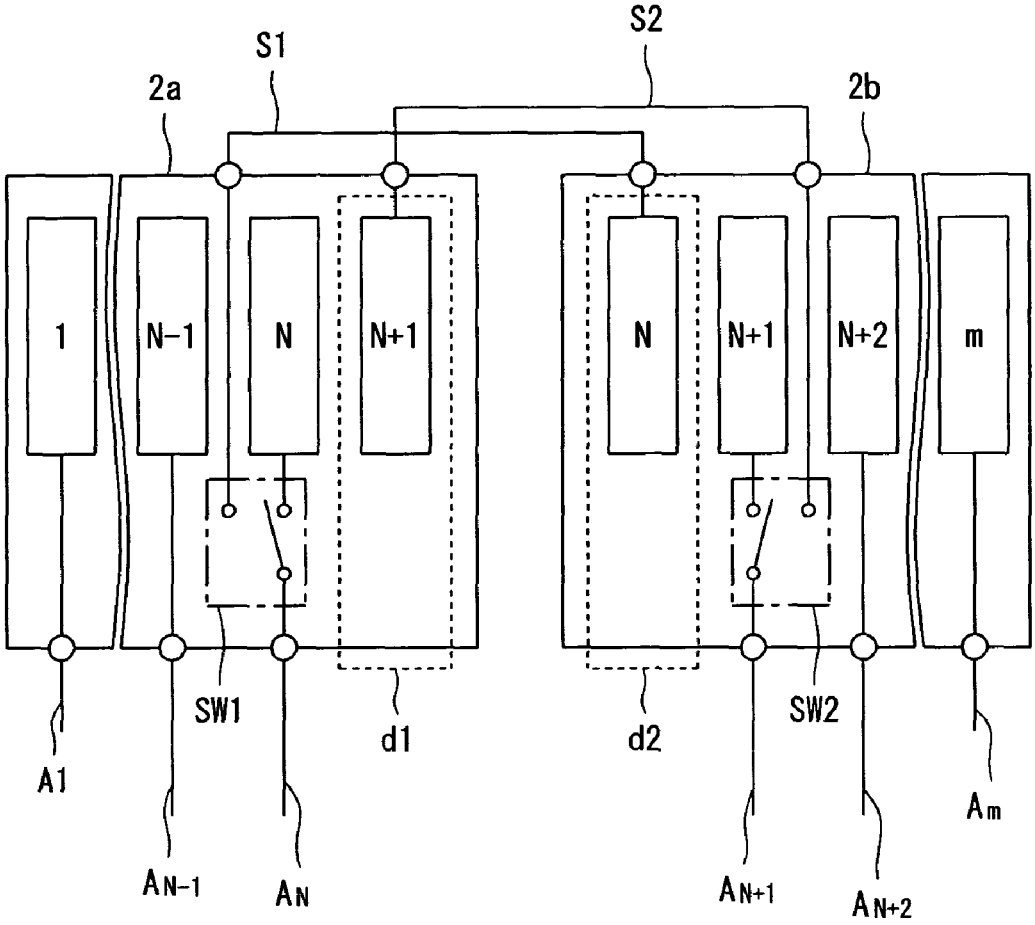
FIG. 14 is a diagram showing main components of a first embodiment of a display panel drive circuit according to the present invention.

FIG. 14 is a diagram showing main components of a first embodiment of a display panel drive circuit according to the present invention. As shown in the figure, the display panel drive circuit according to this embodiment comprises a first IC chip 2*a* and second IC chip 2*b*.

The first IC chip 2*a* has drive outputs corresponding to channel numbers 1 to N+1. Drive outputs corresponding to channel numbers 1 to N−1 are supplied to anode lines $A_1$ to $A_{N-1}$ to drive pixel elements which correspond to the anode lines $A_1$ to $A_{N-1}$.

On the other hand, the second IC chip 2*b* has drive outputs corresponding to channel numbers N to m. Drive outputs corresponding to channel numbers N+2 to m are supplied to anode lines $A_{N+2}$ to $A_m$ to drive pixel elements which correspond to the anode lines $A_{N+2}$ to $A_m$.

In addition to the drive output corresponding to channel number N on the first IC chip 2*a*, the drive output corresponding to channel number N on the second IC chip 2*b* is fed into a switching circuit SW1 of the first IC chip 2*a*. The switching circuit SW1 switches between the two drive outputs and supplies them one at a time to the anode line $A_N$.

Specifically, the switching circuit SW1 receives the drive output corresponding to channel number N which belongs to a drive output group (channel numbers 1 to N+1) of the first IC chip 2*a* and the drive output corresponding to channel number N which belongs to a drive output group (channel numbers N to m) of the second IC chip 2*b*, and supplies the two drive outputs one at a time to the anode line $A_N$ which belongs to the anode lines $A_1$ to $A_N$ of the first drive line group and adjoins the anode lines $A_N$ to $A_m$ of the second drive line group by switching between them in predetermined cycles. The drive output corresponding to channel number N on the second IC chip 2*b* is a dummy drive output d2 which does not correspond to any of the anode lines $A_N$ to $A_m$ (drive lines) of the second drive line group.

Similarly, the drive output corresponding to channel number N+1 on the second IC chip 2*b* as well as the drive output corresponding to channel number N+1 on the first IC chip 2*a* are inputted in a switching circuit SW2 of the second IC chip 2*b*. The switching circuit SW2 switches between the two drive outputs and supplies them one at a time to the anode line $A_{N+1}$.

Specifically, the switching circuit SW2 receives the drive output corresponding to channel number N+1 which belongs to a drive output group (channel numbers N to m) of the second IC chip 2*b* and the drive output corresponding to channel number N+1 which belongs to a drive output group (channel numbers 1 to N+1) of the first IC chip 2*a*, and supplies the two drive outputs one at a time to the anode line $A_{N+1}$ which belongs to the anode lines $A_N$ to $A_m$ of the second drive line group and adjoins the anode lines $A_1$ to $A_N$ of the first drive line group by switching between them in predetermined cycles. The drive output corresponding to channel number N+1 on the first IC chip 2*a* is a dummy drive output d1 which does not correspond to any of the anode lines $A_1$ to $A_N$ (drive lines) of the first drive line group.

Thus, the switching circuits SW1 and SW2 receive dummy drive output from the adjoining IC chip as well as drive outputs within their respective IC chips, supply the two drive outputs to the appropriate anode line in predetermined cycles by switching between them, and thereby perform time-division control. Each of the IC chips 2*a* and 2*b* are equipped with a dummy output at an end. The dummy output from the first IC chip 2*a* is fed into the second IC chip 2*b* while the dummy output from the second IC chip 2*b* is fed into the first IC chip 2*a*.

Incidentally, since the switching circuits SW1 and SW2 are formed in the IC chips 2*a* and 2*b*, all that is necessary is to add wirings S1 and S2, and there is no need to provide additional mounting space.

Figure 15:
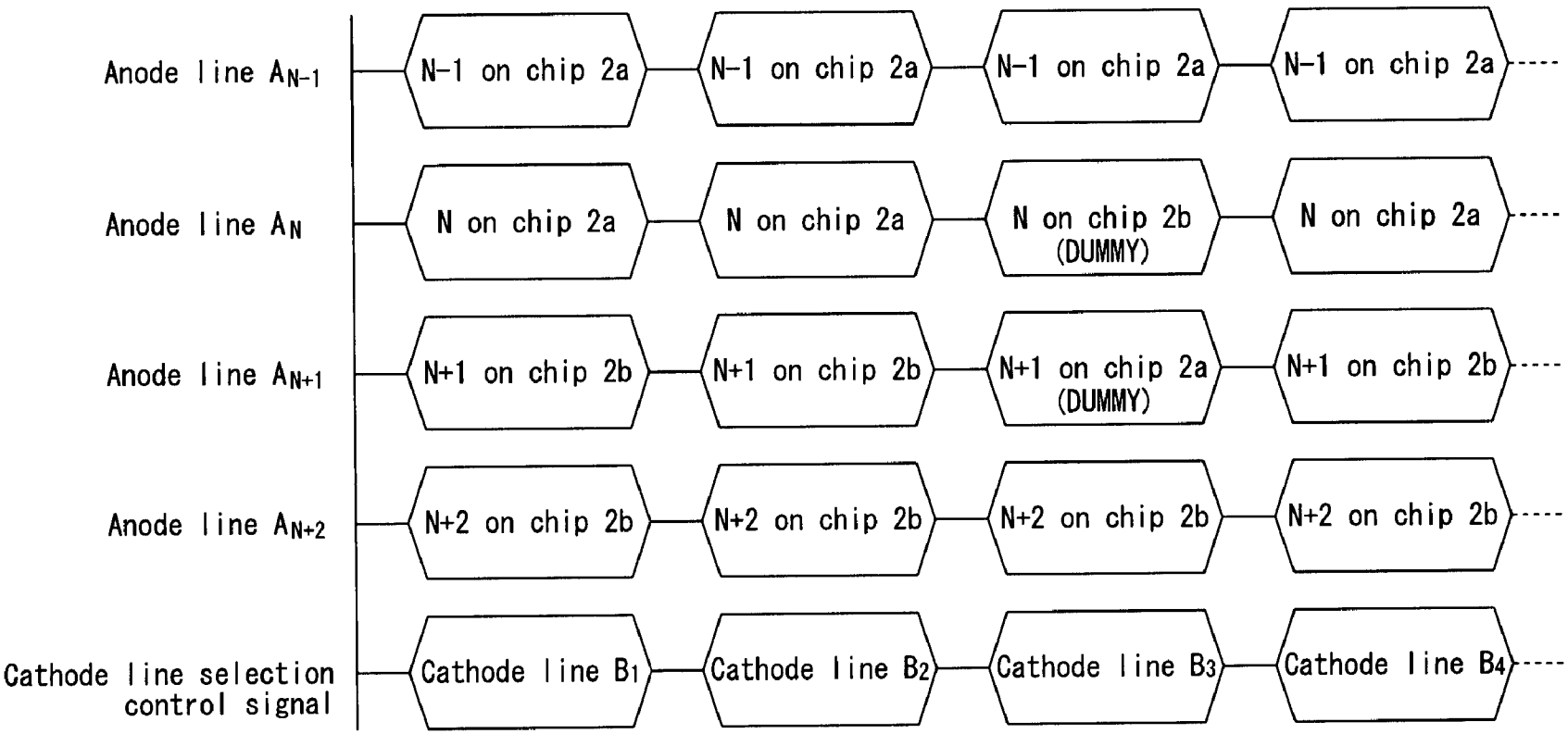
FIG. 15 is a timing chart showing the timing of drive switching made by the display panel drive circuit shown in FIG. 14.

FIG. 15 is an exemplary timing chart showing the timing of drive switching made by the display panel drive circuit. The figure shows an example in which the ratio between the drive output from the first IC chip 2*a* and drive output from the second IC chip 2*b* (hereinafter referred to as a switching ratio), supplied to the anode line $A_N$, is 2:1.

When cathode lines $B_1$, $B_2$, $B_3$, and $B_4$ are selected in sequence by a cathode line selection control signal shown in FIG. 15, the drive output of the IC chip 2*a* or 2*b* is supplied to the anode lines. The anode line $A_{N-1}$ is supplied with the drive output from channel number N−1 on the first IC chip 2*a* while the anode line $A_{N+2}$ is supplied with the drive output from channel number N+2 on the second IC chip 2*b*.

The anode line $A_N$ is supplied with the drive output from channel number N on the first IC chip 2*a* and the drive output (dummy drive output) from channel number N on the second IC chip 2*b* one at a time, with the two outputs switched in predetermined cycles. In this example, two successive drive outputs from channel number N on the first IC chip 2*a* alternate with one drive output from channel number N on the second IC chip 2*b*. In short, the switching ratio between the first IC chip 2*a* and second IC chip 2*b* is 2 to 1.

The anode line $A_{N+1}$ is supplied with the drive output from channel number N+1 on the second IC chip 2*b* and the drive output (dummy drive output) from channel number N+1 on the first IC chip 2*a* one at a time, with the two outputs switched in predetermined cycles. In this example, two successive drive output from channel number N+1 on the second IC chip 2*b* alternate with one drive output from channel number N+1 on the first IC chip 2*a*. In short, the switching ratio between the first IC chip 2*a* and second IC chip 2*b* is 1 to 2.

However, switching cycles are not limited to those shown in FIG. 15, and cycles according to another switching ratio may also be used.

Figure 16:
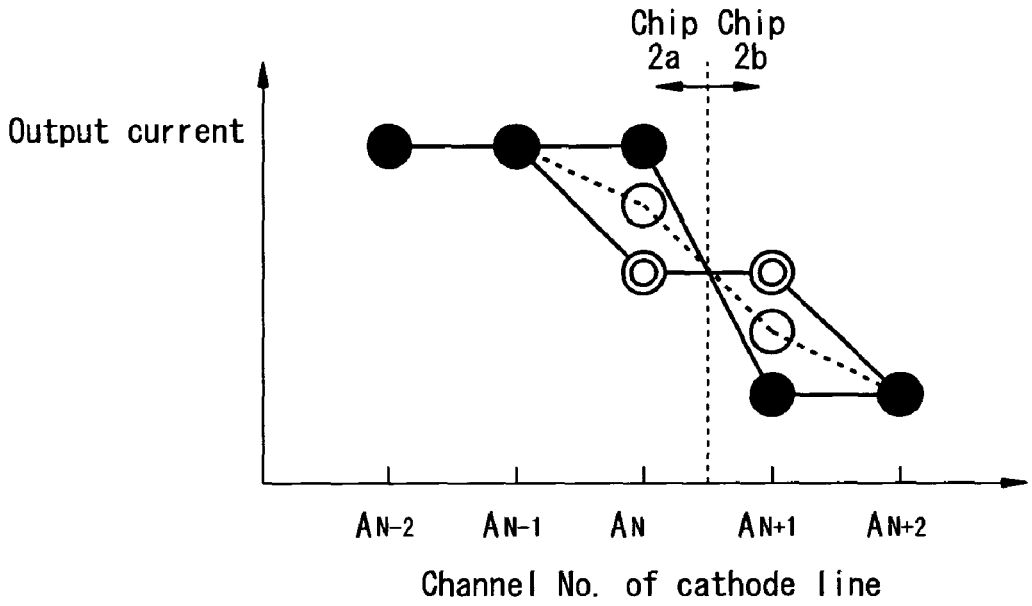
FIG. 16 is a diagram showing relationship between channel numbers of anode lines and output current.

Now, relationship between channel numbers of anode lines and output current will be described with reference to FIG. 16. The figure depicts three cases: the switching ratio in a switching circuit is 1:1, the switching ratio is 2:1, and no switching is made. The solid line linking the black circles ● represents the case in which no switching is made. In this case, the output current from the channel of the anode line $A_N$ and the output current from the channel of the anode line $A_{N+1}$ differ greatly. Such a luminance difference impairs image quality.

On the other hand, the solid line linking the double circles ◎ represents the case in which the switching ratio is 1:1. In this case, there is little difference between the output current from the channel of the anode line $A_N$ and the output current from the channel of the anode line $A_{N+1}$. The difference between the output current from the channel of the anode line $A_{N+1}$ and the output current from the channel of the anode line $A_{N+2}$ as well as the difference between the output current from the anode line $A_{N-1}$ and the output current from the anode line $A_N$ in this case are smaller than the difference between the output current from the anode line $A_N$ and the output current from the anode line $A_{N+1}$ when no switching is made.

The broken line linking the white circles ○ represents the case in which the switching ratio is 2:1. In this case, the output current changes gently from the channel of the anode line $A_{N-1}$ through the channel of the anode line $A_N$ and the channel of the anode line $A_{N+1}$ to the channel of the anode line $A_{N+2}$. Thus, luminance difference is smaller than when the switching ratio is 1:1.

If an anode line drive circuit 2 is constructed from a plurality of IC chips, manufacturing variations and the like will cause differences among IC chips in the value of the light emission drive current to be supplied to the anode lines, resulting in screen areas with different luminance. Even in such a case, by switching between the drive outputs of the IC chips in predetermined cycles and supplying them to the drive lines around the boundary of two drive line groups, it is possible to smooth out luminance changes around the boundary between areas with different luminance and prevent image quality from being impaired.

Figure 17:
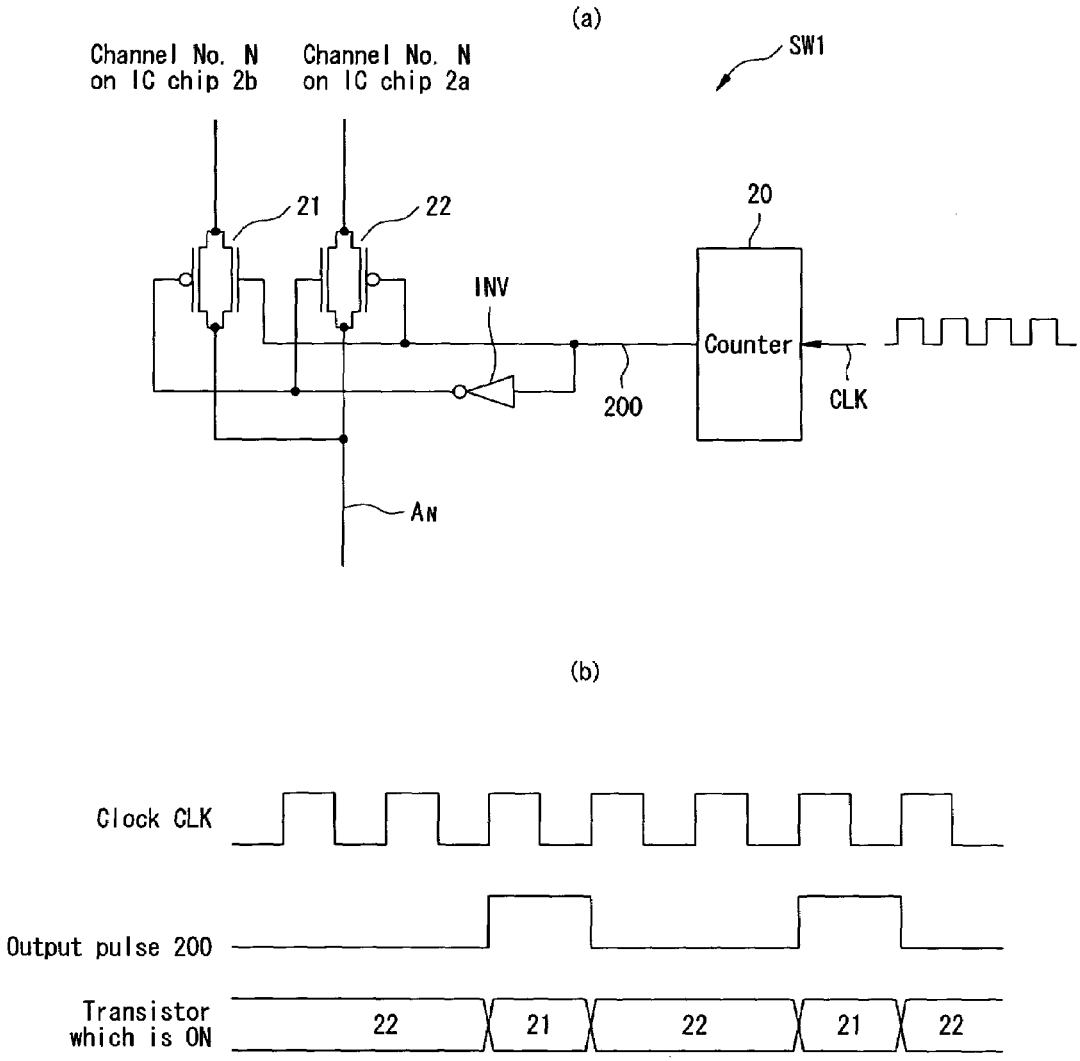
FIG. 17(*a*) is a diagram showing a configuration example of a switching circuit for an anode line.

A configuration example of the switching circuit SW1 for the anode line $A_N$ is shown in FIG. 17. The switching circuit SW1 shown in the figure comprises two analog switches 21 and 22 which are fed current from channel number N on respective IC chips. Each of the analog switches 21 and 22 consists of an n-channel MOS transistor and p-channel MOS transistor which share both the source and drain. The gates of the n-channel MOS transistor and p-channel MOS transistor serve as switching control terminals, which are turned on and off by mutually inverse signals.

The configuration in FIG. 17 includes a counter 20 which supplies an output pulse 200 to the gates serving as the switching control terminals, and an inverter INV which inverts the output pulse 200. The inverter INV consists, for example, of a known CMOS (Complementary Metal Oxide Semiconductor) inverter circuit.

The n-channel MOS transistor of the analog switch 21 and p-channel MOS transistor of the analog switch 22 are fed the output pulse 200 of the counter 20 as it is while the p-channel MOS transistor of the analog switch 21 and n-channel MOS transistor of the analog switch 22 are fed the output pulse 200 logically inverted by the inverter INV. Thus, when the output pulse 200 of the counter 20 is High, the analog switch 21 is ON and the analog switch 22 is OFF. On the other hand, when the output pulse 200 of the counter 20 is Low, the analog switch 21 is OFF and the analog switch 22 is ON.

The counter 20 is fed a clock CLK which is in synchronization with the cathode line selection control signals (see FIG. 15). The clock CLK does counting, generating the output pulse 200 with a duty ratio which corresponds to the ratio described above. The ON/OFF states of the analog switches 21 and 22 are controlled by the output pulse 200 so that only one of the analog switches 21 and 22 will be ON at a time.

Specifically, as shown in FIG. 17(*b*), when the counter 20 which is fed the clock CLK supplies the output pulse 200 to the analog switches 21 and 22, the ratio between the duration for which the analog switch 22 is ON and duration for which the analog switch 21 is ON is 2:1. Consequently, the anode line $A_N$ is supplied with the drive output from channel number N on the first IC chip 2*a* and drive output from channel number N on the second IC chip 2*b* at a ratio of 2:1. Similarly, the switching circuit SW2 for the anode line $A_{N+1}$ can also be constructed from two analog switches and a counter.

Incidentally, although two IC chips are used in the example described above, the present invention is not limited to this. It is obvious that the present invention also applies to cases in which more than two IC chips are used. In that case as well, dummy drive output not corresponding to any drive line on the IC chip and the proper drive output of the adjoining IC chip can be switched in predetermined cycles and supplied to the drive line as is the case with the above example. This can reduce the luminance differences in two display areas caused by differences in current driving capacity among IC chips and reduce degradation of image quality.

Also, although one dummy drive output is provided in each of the adjoining IC chips in the example described above, the present invention is not limited to this. It is obvious that the present invention also applies to cases in which two or more dummy drive outputs are provided in each IC chip. A plurality of dummy drive output corresponding each drive line on the IC chip and a plurality of proper drive outputs of the adjoining IC chip can be switched in predetermined cycles and supplied to the drive line as is the case with the above example. By varying the switching ratio among the drive outputs, it is possible to further reduce the luminance differences in two display areas caused by differences in current driving capacity among IC chips and reduce degradation of image quality.

Also, although the pixel elements composing the display panel are EL elements in the example described above, it is obvious that the present invention also applies to cases in which other elements are used.

Figure 18:
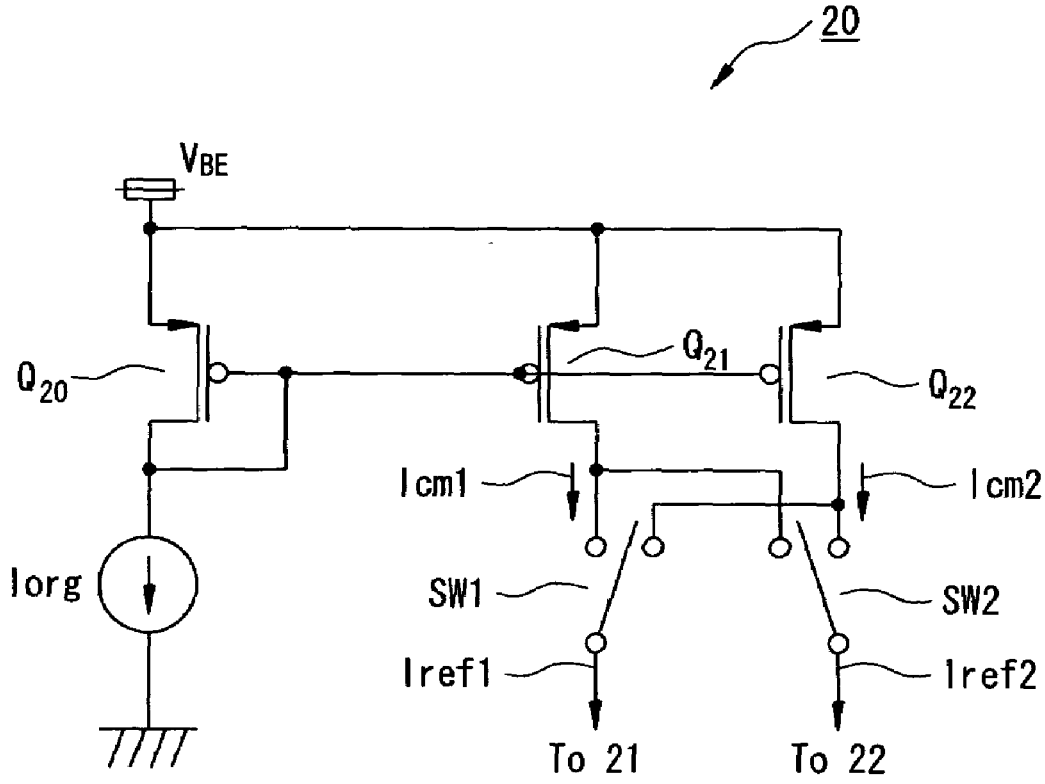
FIG. 18 is a diagram showing main components of a second embodiment of a display panel drive circuit according to the present invention.

FIG. 18 is a diagram showing main components of a second embodiment of a display panel drive circuit according to the present invention. The figure shows a reference current generating circuit. In this example, reference current is supplied to two IC chips.

Figure 7:
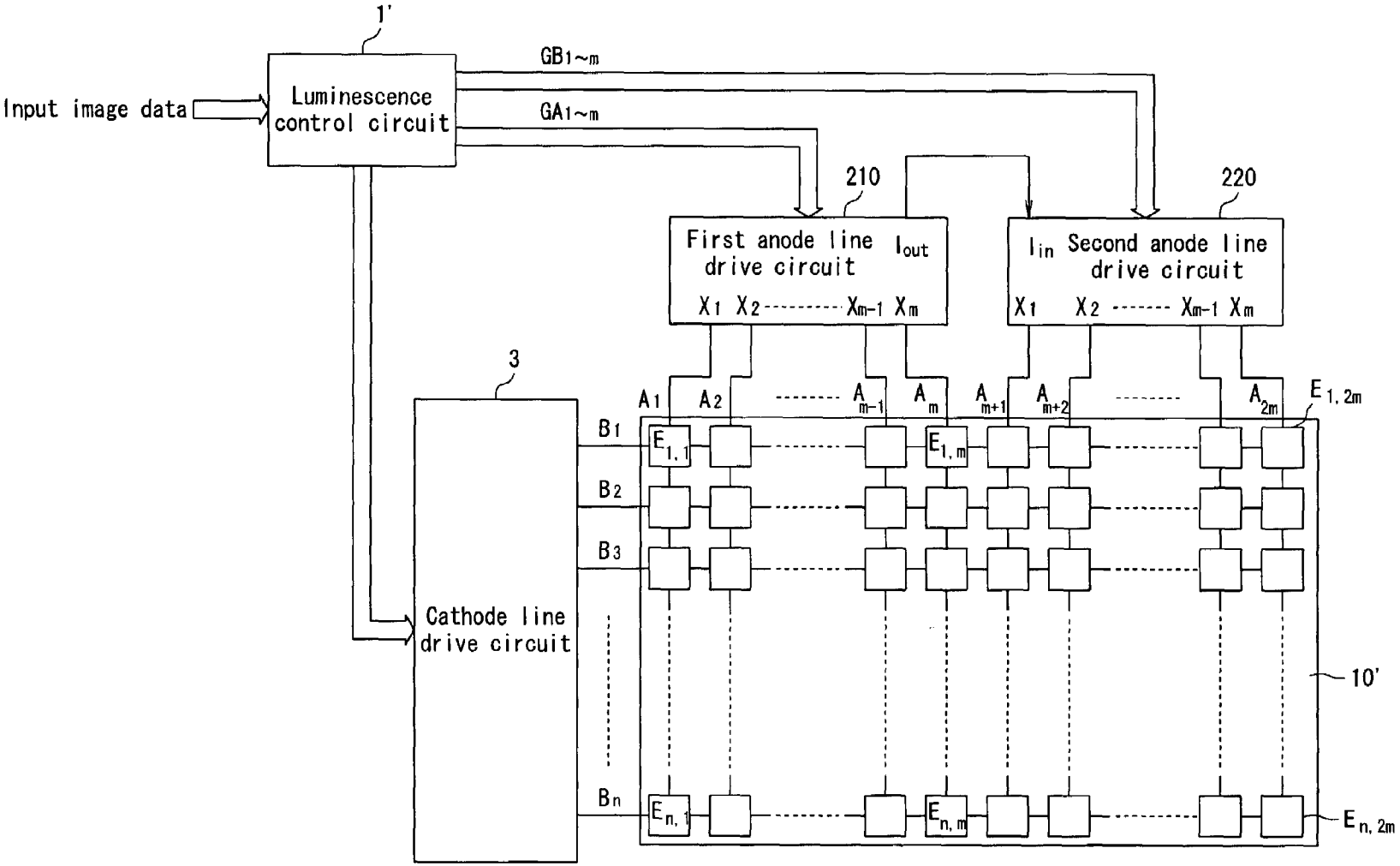
FIG. 7 is a diagram showing an anode line drive circuit constructed from two IC chips.
Figure 8:
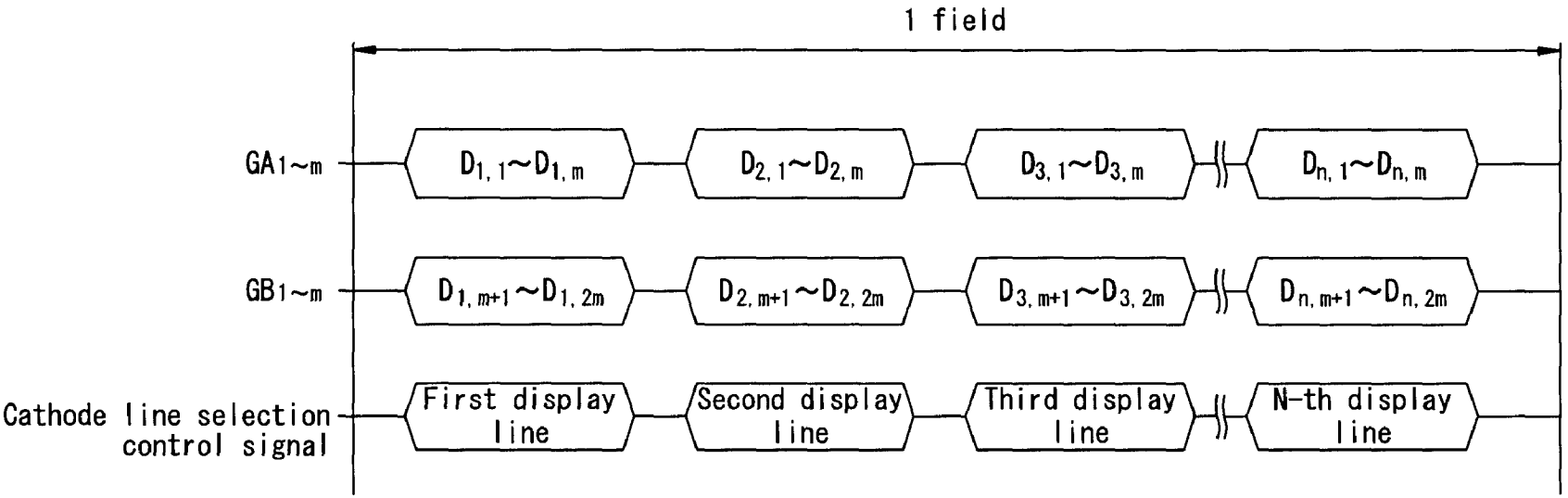
FIG. 8 is a diagram showing the timing for a luminescence control circuit to supply pixel data and a cathode line selection control signal.

As shown in the figure, the reference current generating circuit 20 comprises a current source $I_{org}$, a transistor $Q_{20}$ which compose a reference current source in conjunction with the current source $I_{org}$, and transistors $Q_{21}$ and $Q_{22}$ which use the current source $I_{org}$ and transistor $Q_{20}$ as a common reference current source and compose a current mirror in conjunction with the reference current source. Currents $I_{cm1}$ and $I_{cm2}$ derived from the transistors $Q_{21}$ and $Q_{22}$ are supplied to cathode line drive circuits 210 and 220 consisting of IC ships (see FIG. 7).

Furthermore, the reference current generating circuit 20 comprises switching circuits SW1 and SW2 which switch correspondence between the currents $I_{cm1}$ and $I_{cm2}$ derived from the transistors $Q_{21}$ and $Q_{22}$, and the cathode line drive circuits 210 and 220 in predetermined cycles. To put it in another way, the currents $I_{cm1}$ and $I_{cm2}$ derived from the transistors $Q_{21}$ and $Q_{22}$ are switched by the switching circuits SW1 and SW2, and supplied as output currents $I_{ref1}$ and $I_{ref2}$ to drive circuits 21 and 22 not shown.

Time-division control by means of the switching circuits SW1 and SW2 reduces the amounts of variation between the current source $I_{org}$ which provides the source current of the current mirror and currents $I_{ref1}$ and $I_{ref2}$, and equalizes the current $I_{ref1}$ and current $I_{ref2}$. Specifically, if the amount of variation between the source current $I_{org}$ of the current mirror and the current $I_{cm1}$ generated by the current mirror is $\Delta I_1$ and the amount of variation between the source current $I_{org}$ of the current mirror and the current $I_{cm2}$ generated by the current mirror is $\Delta I_2$, since variations in the output currents $I_{ref1}$ and $I_{ref2}$ of the switching circuits are also time-divided, the average variation is as follows:

$$\text{Average variation}=\tfrac{1}{2}\times\sqrt{(\Delta I_1^2+\Delta I_2^2)}$$

If it is assumed that $\Delta I_1$ and $\Delta I_2$ are equal to $\Delta I$, $$\text{Average variation}=1\sqrt{2}\times\Delta I$$

This is smaller than the amounts of variation in the currents $I_{cm1}$ and $I_{cm2}$ generated by the current mirror.

Also, since the output currents $I_{ref1}$ and $I_{ref2}$ of the switching circuits are equal, variation in output current among IC chips can be reduced even when a plurality of IC chips are used.

Figure 19:
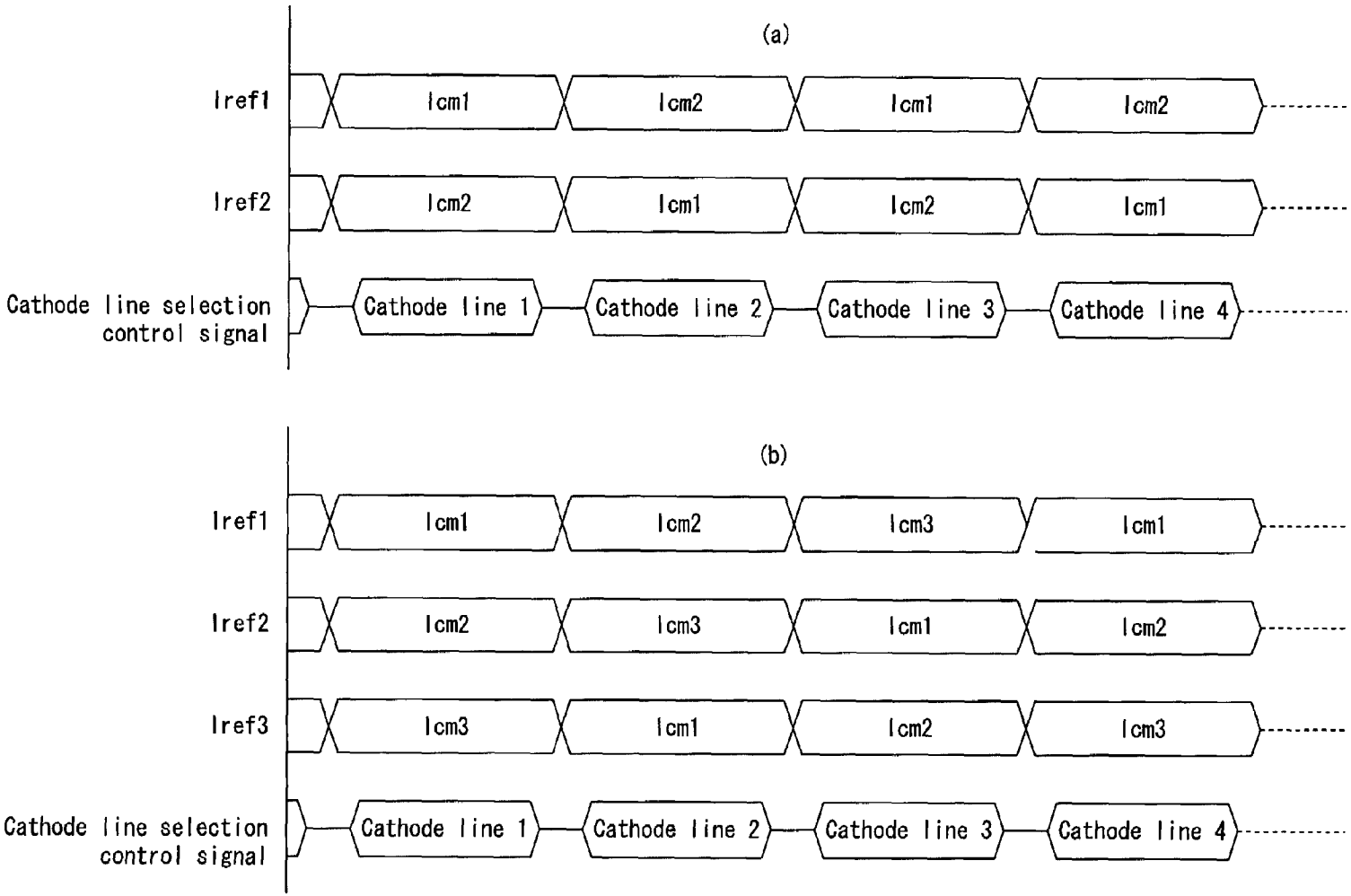
FIG. 19(*a*) is a timing chart showing switch timing of switching circuits.

Switching circuits are operated in synchronization with switching of a cathode line signal. FIG. 19(*a*) is a timing chart showing switch timing of switching circuits. The figure shows how the current $I_{cm1}$ and current $I_{cm2}$ generated by the current mirror are output as the output currents $I_{ref1}$ and $I_{ref2}$ through the operation of the switching circuits SW1 and SW2.

As shown in FIG. 19(*a*), by operating the switching circuits at the time when cathode lines 1, 2, 3, . . . are off, it is possible to reduce switching noise produced when switching between the current $I_{ref1}$ and current $I_{ref2}$. This in turn makes it possible to realize a good image display by avoiding screen flicker and other adverse effects.

Figure 20:
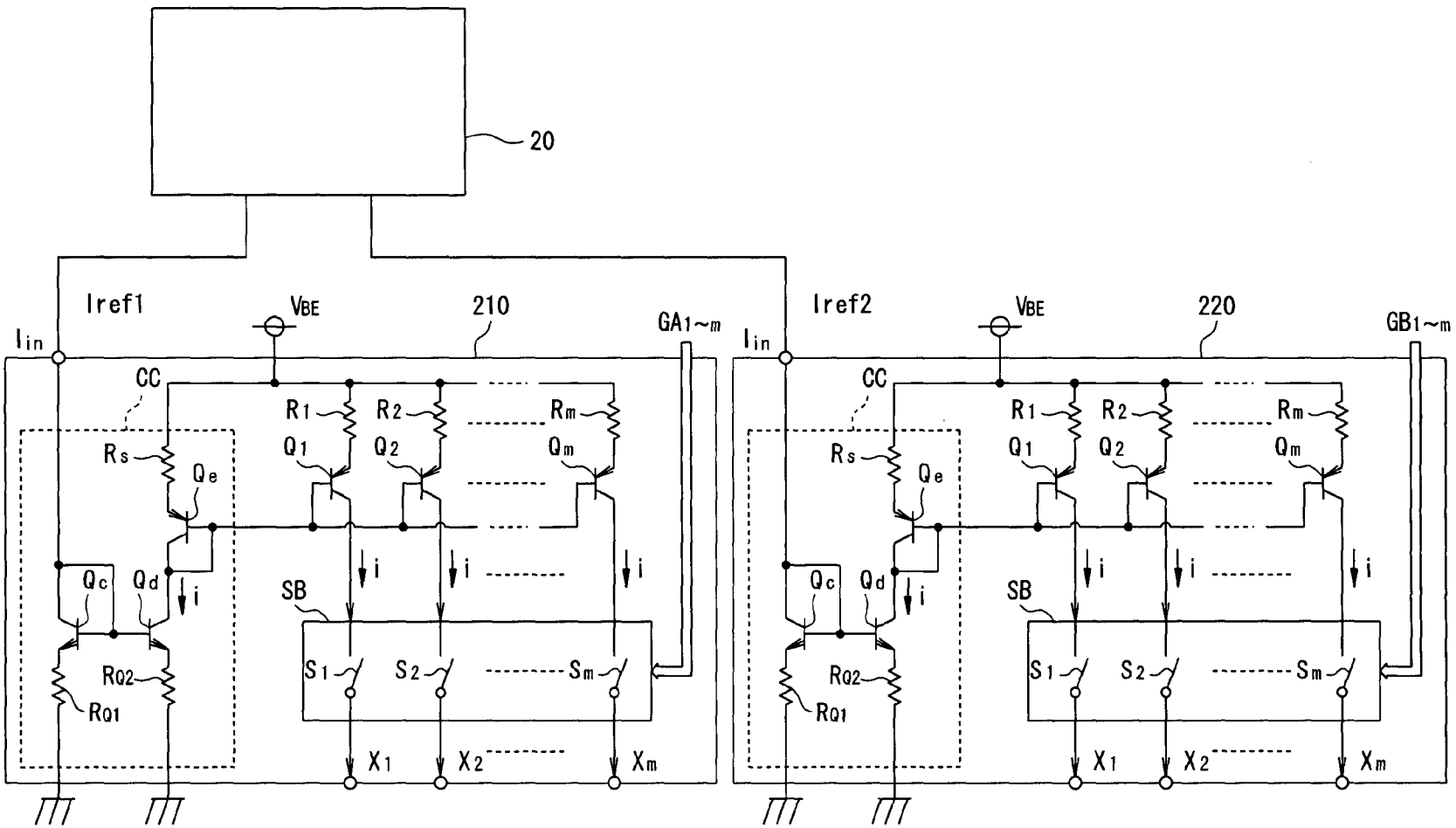
FIG. 20 is a diagram showing how a reference current generating circuit is connected with a first and second anode line drive circuits.

FIG. 20 shows how the reference current generating circuit 20 is connected with the first anode line drive circuit 210 and second anode line drive circuit 220. Referring to the figure, the output current $I_{ref1}$ produced through the switching operations of the switching circuits SW1 and SW2 are fed into the first anode line drive circuit 210 as the reference current for the current mirror while the output current $I_{ref2}$ is fed into the second anode line drive circuit 220 as the reference current for the current mirror.

Since the output current $I_{ref1}$ and output current $I_{ref2}$ from the switching circuits of the reference current generating circuit 20 described above are equal to each other, it is possible to reduce variation in the currents supplied, respectively, to the first anode line drive circuit 210 and second anode line drive circuit 220 constructed from different IC chips.

Figure 21:
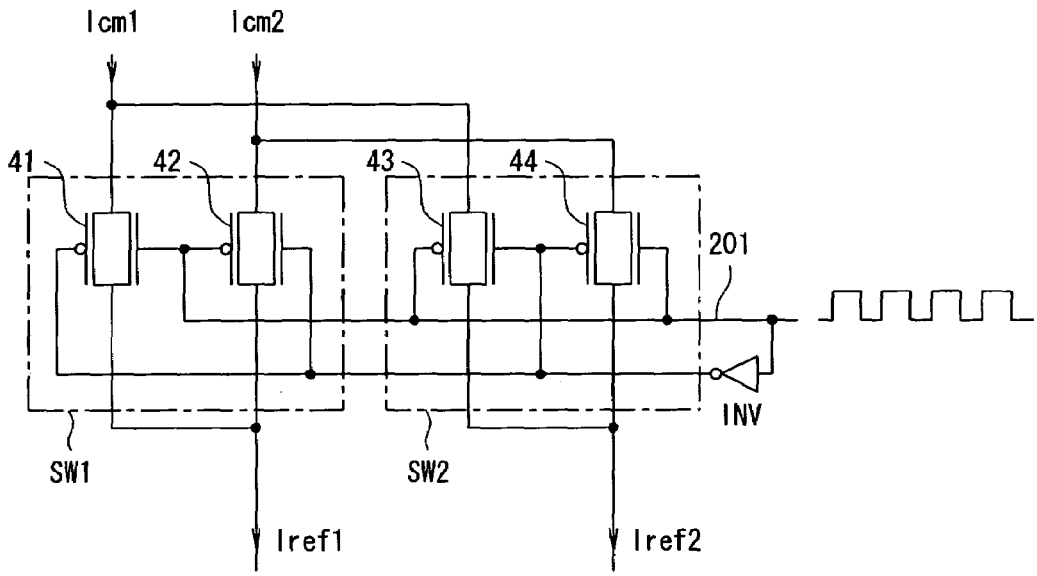
FIG. 21 is a diagram showing a configuration example of switching circuits.

FIG. 21 shows a configuration example of switching circuits SW1 and SW2. Both switching circuits SW1 and SW2 in the figure are constructed from MOS transistors, etc.

The switching circuits SW1 and SW2 shown in FIG. 21 comprises two analog switches 41 and 42 or analog switches 43 and 44, which are fed current outputted from channel number N on respective IC chips. Each of the analog switches 41, 42, 43, and 44 consists of an n-channel MOS transistor and p-channel MOS transistor which share both the source and drain. The gates of the n-channel MOS transistor and p-channel MOS transistor serve as switching control terminals, which are turned on and off by mutually inverse signals.

The configuration in FIG. 17 includes an inverter INV which supplies an inverted pulse 201 to the gates serving as the switching control terminals. The inverter INV consists, for example, of a known CMOS inverter circuit.

The n-channel MOS transistor of the analog switch 41, p-channel MOS transistor of the analog switch 42, p-channel MOS transistor of the analog switch 43, and n-channel MOS transistor of the analog switch 44 are fed the pulse 201 as it is while the p-channel MOS transistor of the analog switch 41, n-channel MOS transistor of the analog switch 42, n-channel MOS transistor of the analog switch 43, and p-channel MOS transistor of the analog switch 44 are fed the output pulse 201 logically inverted by the inverter INV. Thus, when the pulse 201 is High, the analog switches 41 and 44 are ON and the analog switches 42 and 43 are OFF. On the other hand, when the pulse 201 is Low, the analog switches 41 and 44 are OFF and the analog switches 42 and 43 are ON.

During the former period, the current $I_{cm1}$ is derived as the output current $I_{ref1}$ and the current $I_{cm2}$ is derived as the output current $I_{ref2}$. On the other hand, during the latter period, the current $I_{cm1}$ is derived as the output current $I_{ref2}$ and the current $I_{cm2}$ is derived as the output current $I_{ref1}$. By configuring the switching circuits in the manner described above, it is possible to reduce variation in output current among IC chips even when a plurality of IC chips are used.

Incidentally, although in the embodiment described above, the reference current generating circuit 20 is installed outside the cathode line drive circuits 210 and 220 each constructed from an IC chip, it is also possible to install the reference current generating circuit 20 in the IC chips and supply the output current $I_{ref1}$ to one of the IC chips, and the output current $I_{ref2}$ to the other IC chip. In that case, the display panel drive circuit can be constructed from only two IC chips with one of the IC chips serving as a master IC and the other IC chip serving as a slave IC.

Also, although two IC chips are used in the example described above, even if more than two IC chips are used, by switching correspondence (electrical connection) between the IC chips and drive current supply sources in predetermined cycles, it is possible to reduce variation in output current among IC chips.

For example, if a plurality of drive current sources are provided for a plurality of IC chips and connection between the IC chips and drive current sources is switched in rotation in predetermined cycles, the drive currents of the IC chips can be averaged and almost equalized. FIG. 19(*b*) is a timing chart showing the timing to switch among three drive current sources in rotation among three IC chips.

Figure 22:
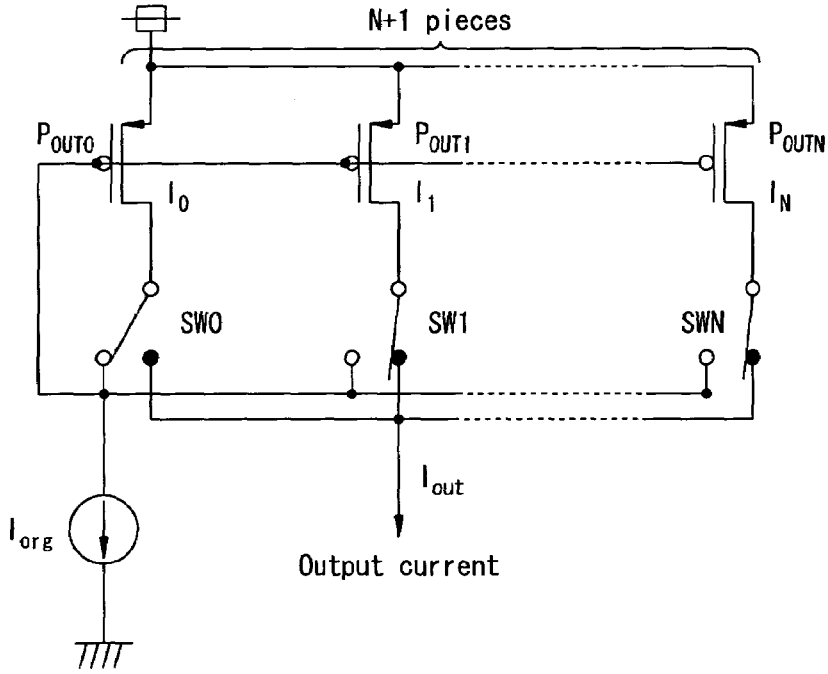
FIG. 22 is a diagram showing main components of a third embodiment of a display panel drive circuit according to the present invention.

FIG. 22 is a diagram showing main components of a third embodiment of a display panel drive circuit according to the present invention. The figure shows a current mirror circuit composed of N+1 MOS transistors.

As shown in FIG. 22, the current mirror circuit comprises a current source $I_{org}$, the N+1 MOS transistors $P_{OUT0}$, $P_{OUT1}$, . . . , and $P_{OUTN}$, and switching circuits SW0, SW1, . . . , and SWN. The switching circuits SW0, SW1, . . . , and SWN electrically connects only one of the N+1 MOS transistors $P_{OUT0}$, $P_{OUT1}$, . . . , and $P_{OUTN}$ to the current source $I_{org}$. The MOS transistor connected to the current source $I_{org}$ serves as a reference current source for the current mirror in conjunction with the current source $I_{org}$. The output currents from the other N MOS transistors are used as drive output for the display panel. In this example, the outputs from the N MOS transistors $P_{OUT1}$ to $P_{OUTN}$ are merged into an output current $I_{out}$, which is derived as a drive output.

In FIG. 22, in relation to the switching circuits SW0, SW1, . . . , and SWN, terminals connected to the current source $I_{org}$ are indicated by ○ while terminals connected to a signal line which derives the output current $I_{out}$ are indicated by ●. When the switching circuit SW0 is connected to the ○ terminal, the other switching circuits SW1 to SWN are connected to the respective terminals. When the switching circuit SW1 is connected to the ○ terminal, the switching circuits SW0 and SW2 to SWN are connected to the respective terminals. In this way, the switching circuit connected to the ○ terminal is changed in sequence. This switching is made in synchronization with a clock.

As the switching circuits SW0, SW1, . . . , and SWN are operated in this way, the transistor which serves as a reference current source is switched periodically from among the N+1 MOS transistors $P_{OUT0}$, $P_{OUT1}$, $P_{OUT2}$, and $P_{OUTN}$. Specifically, through the operation of the switching circuits, each of the N+1 MOS transistors is set to the first proportional "1" of a current ratio 1:N in sequence so as to have a major current variation. Through this switching control, current variation among all the N+1 MOS transistors is controlled in a time-divided manner. In short, they are controlled in such a way as to be averaged over time. This suppresses current variation.

Suppose the number of transistors N=3 and the variation among transistors is 1%. Whereas conventionally current variation is around 1.4%, with the circuit according to the present invention, current variation is around 0.01%. Thus, the current variation is reduced considerably.

Figure 23:
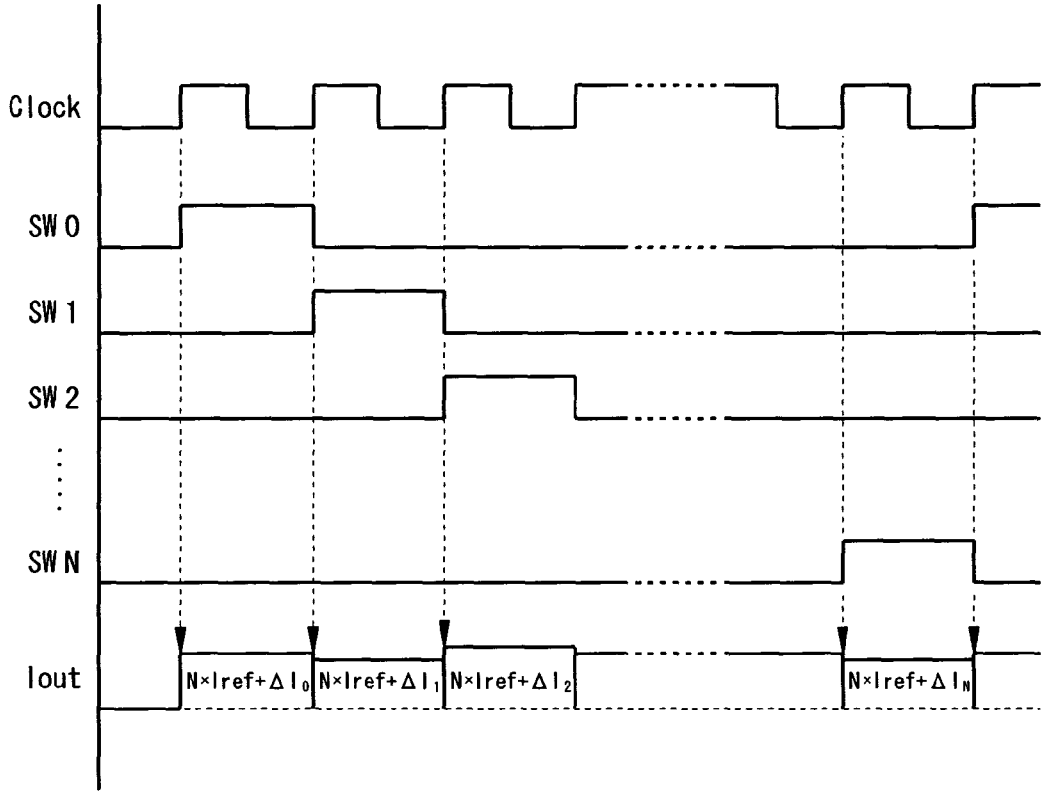
FIG. 23 is a timing chart showing switch timing of switching circuits.

FIG. 23 is a timing chart showing switch timing of the switching circuits SW0 to SWN. The figure shows a clock which provides the timing for switching the switching circuits, ON/OFF states of the switching circuits, and the output current $I_{out}$. Incidentally, in the figure, the switching circuits are ON when they are High.

In FIG. 23, when the switching circuit SW0 is ON, the output current $I_{out}$ is $N \times I_{ref} + \Delta I_0$. Similarly, when the switching circuit SW1 is ON, the output current $I_{out}$ is $N \times I_{ref} + \Delta I_1$; when the switching circuit SW2 is ON, the output current $I_{out}$ is $N \times I_{ref} + \Delta I_2$; and when the switching circuit SWN is ON, the output current $I_{out}$ is $N \times I_{ref} + \Delta I_N$. In this way, the transistor which serves as the reference current source is changed periodically by the switching circuits.

As described above, by periodically changing the transistor which serves as the reference current source, it is possible to reduce the amount of current variation.

Figure 24:
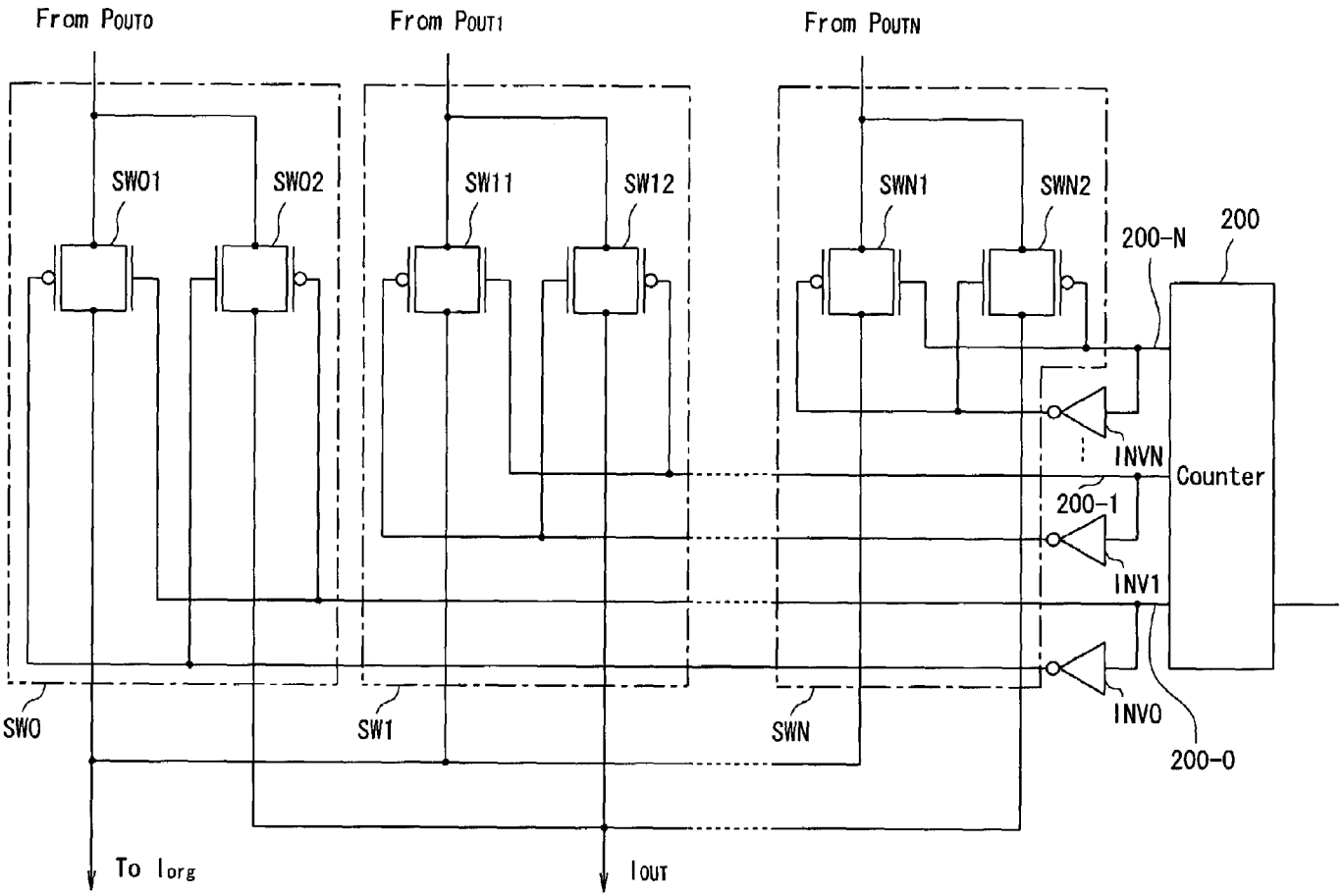
FIG. 24 is a diagram showing a configuration example of the switching circuits shown in FIG. 22.

FIG. 24 shows a configuration example of the switching circuits shown in FIG. 22. Each of the switching circuits SW0 to SWN in FIG. 24 comprises two analog switches and is fed current outputted from the corresponding one of the MOS transistors $P_{OUT0}$ to $P_{OUTN}$. The switching circuit SW0 comprises analog switches SW01 and SW02. Each of the analog switches SW01 and SW02 consists of an n-channel MOS transistor and p-channel MOS transistor which share both the source and drain. The common gate of the n-channel MOS transistor and p-channel MOS transistor serves as a switching control terminal. The configuration in FIG. 24 includes a counter 200 which is fed the clock described above, and inverters INV0 to INVN which are installed for the respective switching circuits SW0 to SWN and invert outputs 200-0 to 200-N of the counter 200. The inverters INV0 to INVN consist, for example, of a known CMOS inverter circuit.

The n-channel MOS transistor of the analog switch SW01 and p-channel MOS transistor of the analog switch SW02 are fed counter 200 output as it is while the p-channel MOS transistor of the analog switch SW01 and n-channel MOS transistor of the analog switch SW02 are fed counter 200 output logically inverted by the inverter INV0. Thus, the analog switch SW01 is ON only when the output 200-0 of the counter 200 is High, and the analog switch SW02 is ON when the output 200-0 of the counter 200 is Low.

Similarly, in the case of the switching circuit SW1 consisting of analog switches SW11 and SW12, the analog switch SW11 is ON only when the output 200-1 of the counter 200 is High, and the analog switch SW12 is ON when the output 200-1 of the counter 200 is Low. The same applies to the other switching circuits: in the switching circuit SWN, the analog switch SWN1 is ON only when the output 200-N of the counter 200 is High, and the analog switch SWN2 is ON when the output 200-N of the counter 200 is Low.

Incidentally, as shown in FIG. 24, the outputs of the analog switches SW01, SW11, . . . , and SWN1 are connected to the current source $I_{org}$ while the outputs of the analog switches SW02, SW12, . . . , and SWN2 are merged into an output current $I_{out}$.

In this configuration, the counter 200 is fed the clock shown in FIG. 23. It sets only one of the outputs 200-1 to 200-N to High in turns. Thus, it shifts the outputs set to High in sequence. By shifting the high pulse among the outputs in this way, it periodically changes the transistor which serves as the reference current source from among the N+1 MOS transistors as shown in FIG. 23. Consequently, each of the N+1 MOS transistors is set to the first proportional "1" of the current ratio 1:N in sequence so as to have a major current variation. Through this switching control, current variation among all the N+1 MOS transistors is controlled in a time-divided manner. This configuration makes it possible to reduce current variation without increasing the amount of the current of the current source $I_{org}$.

Therefore, this circuit can reduce current variation in the current mirror without increasing power consumption of the IC chips. Thus, as the switching circuits are controlled using a clock with a repetition frequency of, for example, 1000 Hz, the current supplied to a display panel composed of organic electroluminescent elements can be averaged overtime. This produces uniform emission luminance on the display panel.

Figure 25:
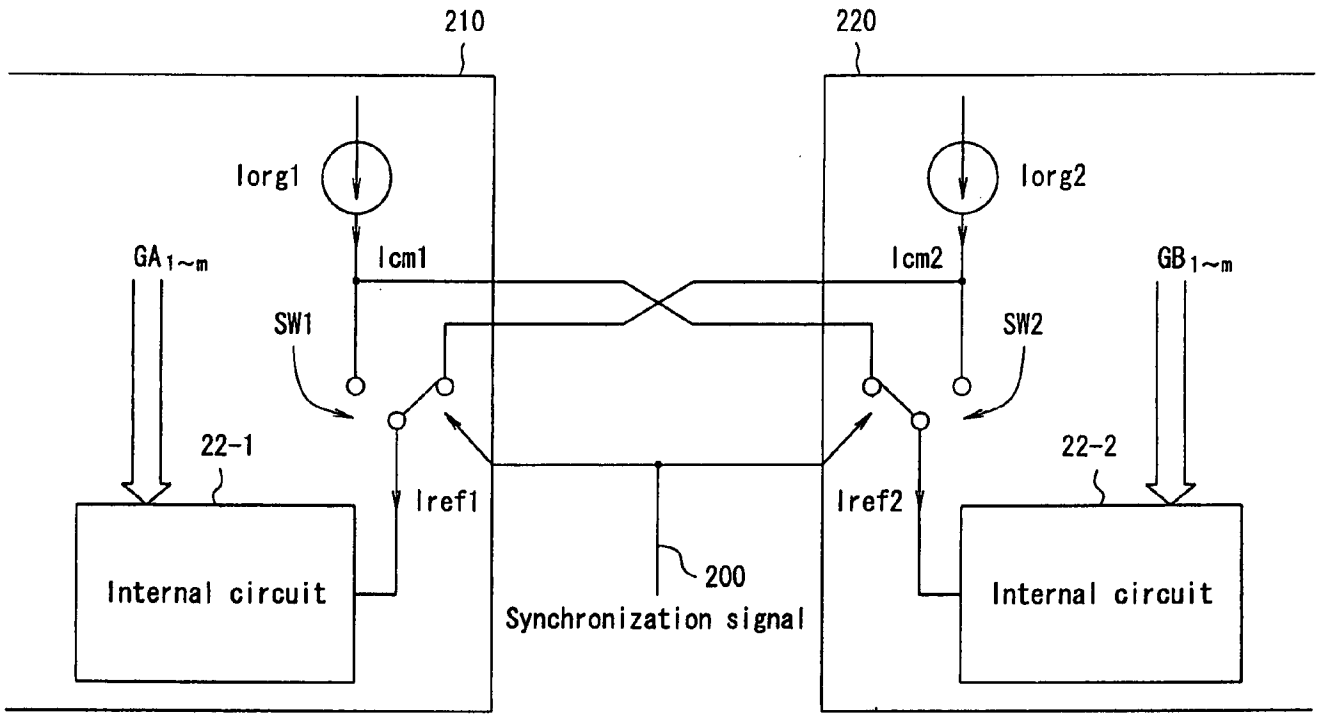
FIG. 25 is a diagram showing main components of a fourth embodiment of a display panel drive circuit according to the present invention.

FIG. 25 is a diagram showing main components of a fourth embodiment of a display panel drive circuit according to the present invention. The figure shows a case in which two IC chips are used.

As shown in FIG. 25, a first anode line drive circuit 210 made of an IC chip contains a current source $I_{org1}$ which outputs a reference current for a current mirror, and a switching circuit SW1 which receives, as one of inputs, a reference current $I_{cm1}$ outputted from the current source $I_{org1}$. The reference current $I_{cm1}$ is also fed into a switching circuit SW2 in a second anode line drive circuit 220 made of another IC chip.

The second anode line drive circuit 220 contains a current source $I_{org2}$ which outputs a reference current for a current mirror, and the switching circuit SW2 which receives, as one of inputs, a reference current $I_{cm2}$ outputted from the current source $I_{org2}$. The reference current $I_{cm2}$ is also fed into a switching circuit SW1 in the anode line drive circuit 210.

Figure 9:
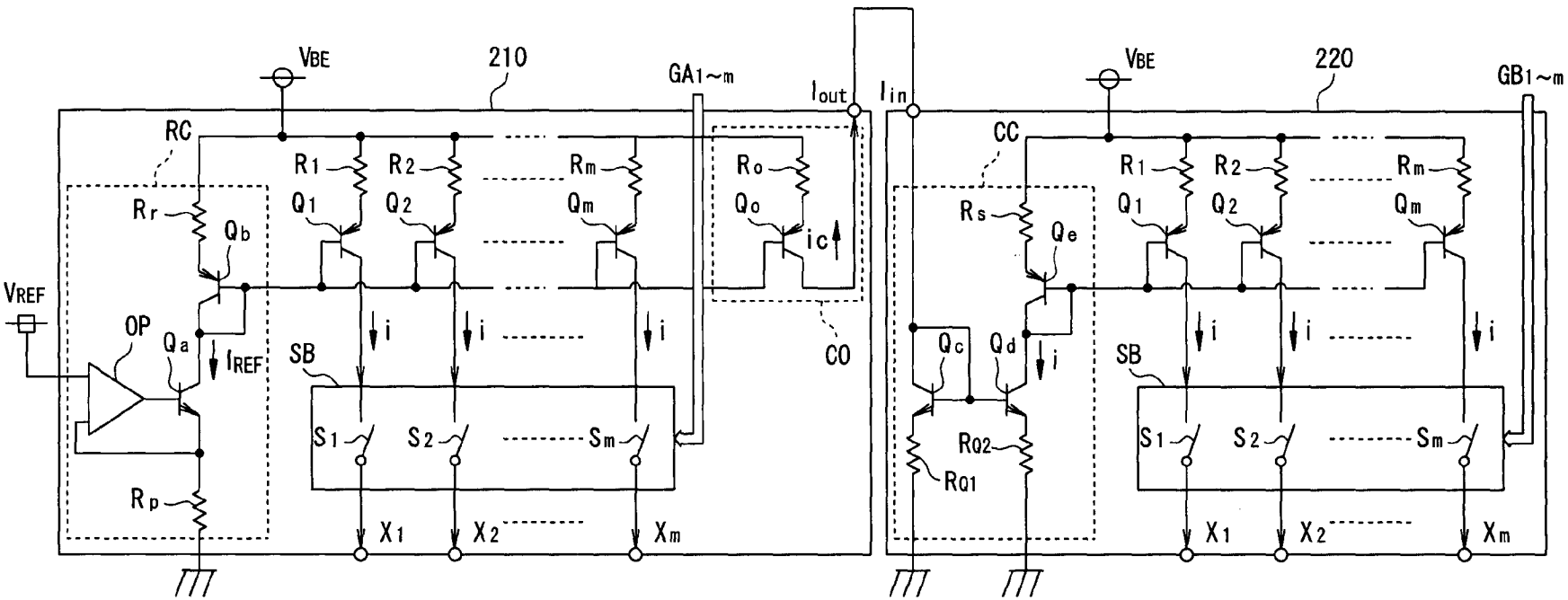
FIG. 9 is a diagram showing an exemplary internal configuration of an anode line drive circuit.
Figure 10:
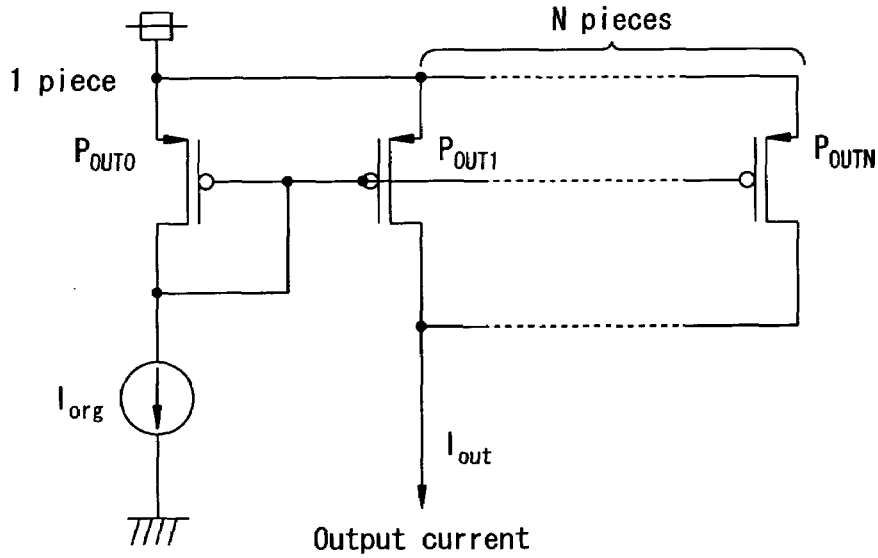
FIG. 10 is a diagram showing configuration of a typical current mirror circuit constructed using MOS transistors.
Figure 11:
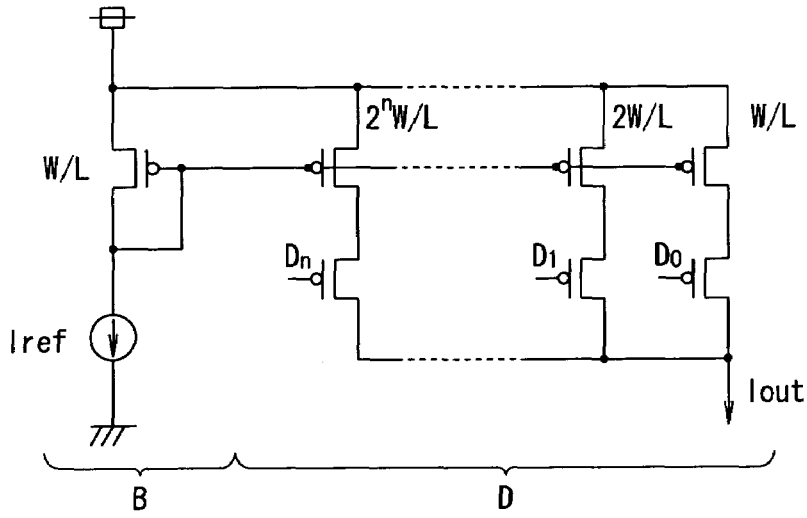
FIG. 11 is a diagram showing configuration of a current DAC circuit used as a constant current source for an anode line drive circuit.
Figure 12:
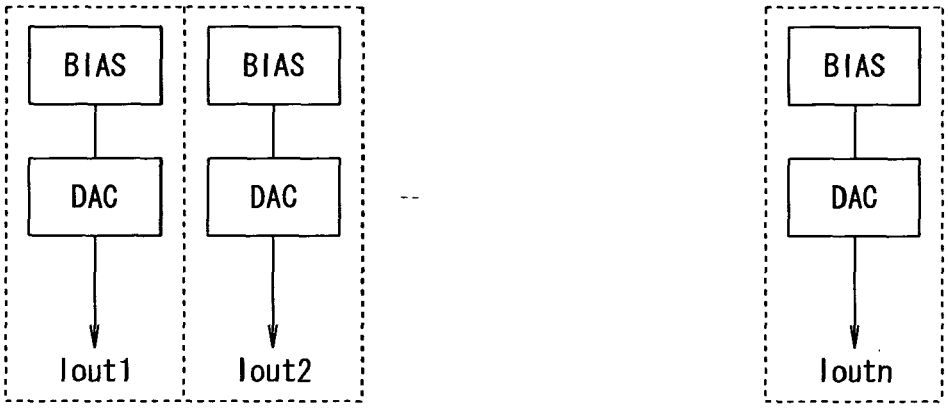
FIG. 12 is a diagram showing a multi-channel current DAC circuit which has a plurality of BIAS portions and a plurality of DAC portions.
Figure 13:
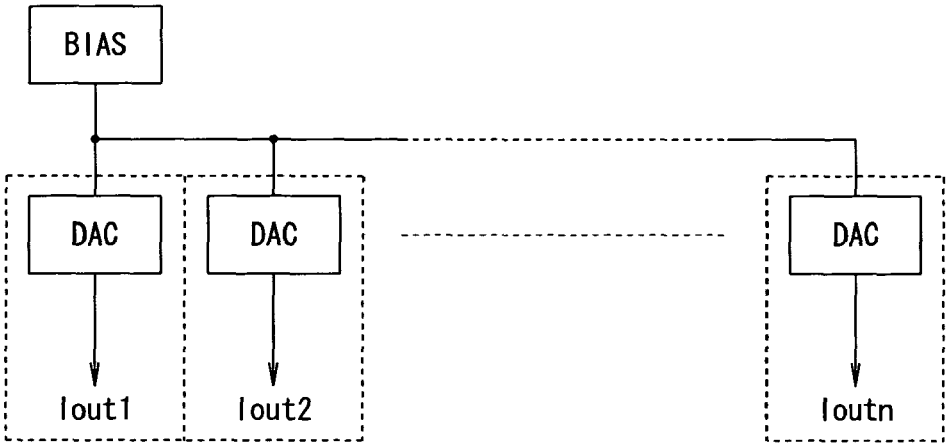
FIG. 13 is a diagram showing a multi-channel current DAC circuit which has a single BIAS portion and a plurality of DAC portions.

An internal circuit 22-1 in the anode line drive circuit 210 and an internal circuit 22-2 in the second anode line drive circuit 220 have a configuration equivalent to that of the second anode line drive circuit 220 in FIG. 9. Specifically, the internal circuits 22-1 and 22-2 have a current mirror, with which they generate drive current for driving the display panel.

The internal circuit 22-1 is fed a reference current $I_{ref1}$, which is either the reference current $I_{cm1}$ or $I_{cm2}$ selected by the switching circuit SW1. Similarly, the internal circuit 22-2 is fed a reference current $I_{ref2}$, which is either the reference current $I_{cm1}$ or $I_{cm2}$ selected by the switching circuit SW2.

The switching circuits SW1 and SW2 are controlled by a synchronization signal 200 synchronized with a scan line selection signal. The switching circuit SW1 and switching circuit SW2 are controlled in such a way as to select different one of the reference currents $I_{cm1}$ and $I_{cm2}$. Specifically, the switching circuits switch between the output currents from the current source $I_{org1}$ and current source $I_{org2}$ for time-division control based on the synchronization signal 200 from outside. Thus, the output currents are controlled in such a way as to be averaged over time.

Consequently, current is fed into the internal circuits alternately to allow each of the anode line drive circuits 210 and 220 to use averaged current internally. As a result of time-division switching control, the reference current $I_{ref1}$ and reference current $I_{ref2}$ fed into the anode line drive circuits 210 and 220 equal the time-average of the reference current $I_{cm1}$ and reference current $I_{cm2}$ supplied from the current sources $I_{org1}$ and current source $I_{org2}$. Thus, the reference current $I_{ref1}$ and reference current $I_{ref2}$ become equal to each other. Specifically, by switching the current source $I_{org1}$ and current source $I_{org2}$ of the anode line drive circuits 210 and 220 at a duty ration of ½ (50%), it is possible to obtain averaged current. By driving the display panel using such an averaged current, it is possible to eliminate variation between referrence currents, and thus obtain uniform emission luminance on the display panel.

The operation of the switching circuits is similar to the one shown in FIG. 19(*a*). The Figure shows the reference current $I_{ref1}$ fed into the anode line drive circuit 210, reference current $I_{ref2}$ fed into the anode line frive circuit 220, and scan line selection signal. As shown in the Figure, the switching circuits SW1 and SW2 are switched, timed with switching of the cathode line. As a result of this switching control, the reference current $I_{cm1}$ outputted from the current source $I_{org1}$ and the reference current $I_{cm2}$ outputted from the current source $I_{org2}$ are fed alternately as the reference current $I_{ref1}$ and reference current $I_{ref2}$ into the anode line drive circuit 210 and the anode line drive circuit 220. Consequently, an averaged current is supplied to the plurality of anode line drive circuits. Thus, even if there are variations among the currents outputted from a plurality of IC chips (anode line drive circuits), each of the IC chips operates on averaged current in the long run, eliminating variation between reference currents. This makes it possible to obtain uniform emission luminance on the display panel.

If the switching control is performed when the cathode line current is OFF, in particular, the noise produced by the switching operation of the reference current $I_{ref1}$ and reference current $I_{ref2}$ can be minimized. This makes it possible to realize a better image display by avoiding screen flicker and other adverse effects.

Figure 26:
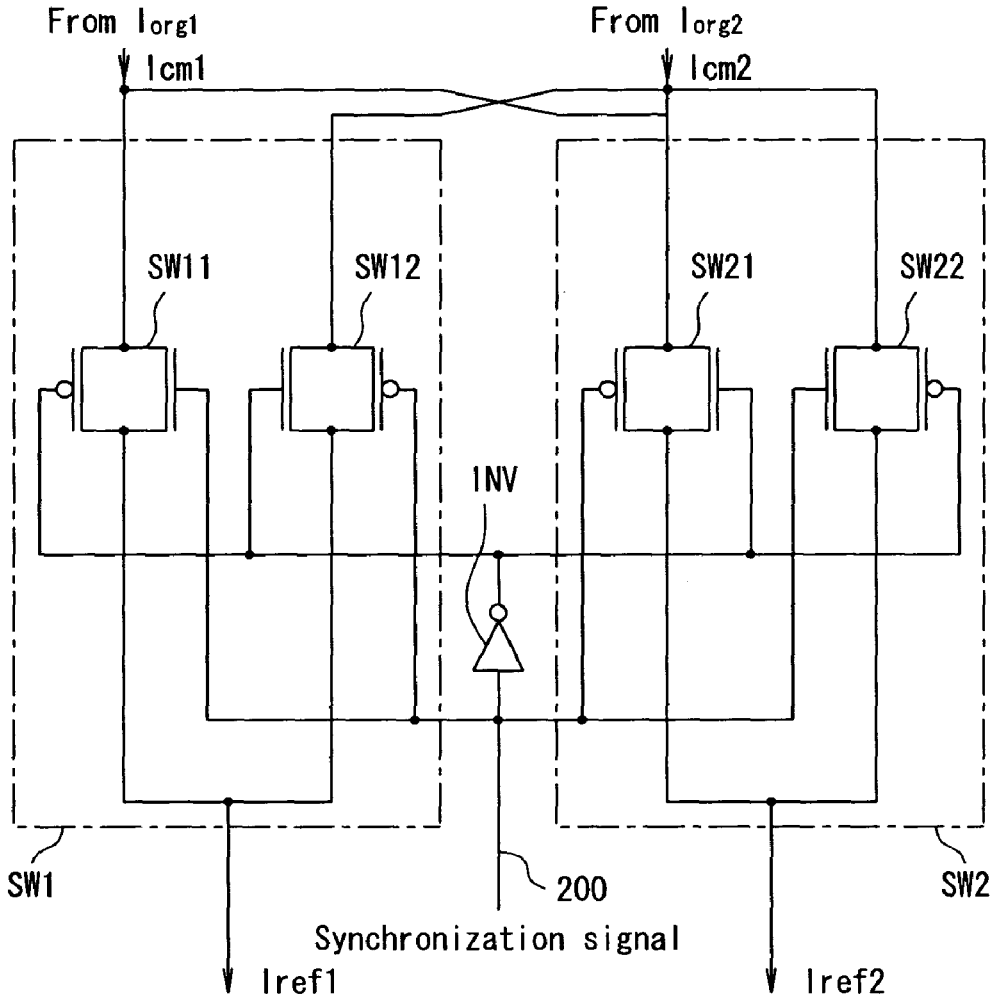
FIG. 26 is a diagram showing a configuration example of the switching circuits shown in FIG. 25.

A configuration example of switching circuits is shown in FIG. 26. Each of the switching circuits SW1 and SW2 shown in FIG. 26 comprises two analog switches which are fed the current $I_{cm1}$ and current $I_{cm2}$ outputted from respective reference current sources $I_{org1}$ and $I_{org2}$. The switching circuit SW1 consists of analog switches SW11 and SW12. Each of the analog switches SW11 and SW12 consists of an n-channel MOS transistor and p-channel MOS transistor which share both the source and drain. The gates of the n-channel MOS transistor and p-channel MOS transistor serve as switching control terminals, which are turned on and off by mutually inverse signals. The outputs of the analog switches SW11 and SW12 are merged into the reference current $I_{ref1}$ as described above.

Similarly, the switching circuit SW2 consists of analog switches SW21 and SW22. Each of the analog switches SW21 and SW22 consists of an n-channel MOS transistor and p-channel MOS transistor which share both the source and drain. The gates of the n-channel MOS transistor and p-channel MOS transistor serve as switching control terminals, which are turned on and off by mutually inverse signals. The outputs of the analog switches SW21 and SW22 are merged into the reference current $I_{ref2}$ as described above.

The configuration in the figure includes an inverter INV which inverts the synchronization signal 200 described above. The inverter INV consists, for example, of a known CMOS inverter circuit.

The n-channel MOS transistor of the analog switch 11 and p-channel MOS transistor of the analog switch 12 are fed the synchronization signal 200 as it is while the p-channel MOS transistor of the analog switch 11 and n-channel MOS transistor of the analog switch 12 are fed the synchronization signal 200 logically inverted by the inverter INV. Thus, when the synchronization signal 200 is High, the analog switch 11 is ON and when the synchronization signal 200 is Low, the analog switch 12 is ON.

On the other hand, the p-channel MOS transistor of the analog switch 21 and n-channel MOS transistor of the analog switch 22 are fed the synchronization signal 200 as it is while the n-channel MOS transistor of the analog switch 21 and p-channel MOS transistor of the analog switch 22 are fed the synchronization signal 200 logically inverted by the inverter INV. Thus, when the synchronization signal 200 is High, the analog switch 22 is ON and when the synchronization signal 200 is Low, the analog switch 21 is ON.

With this configuration, when the synchronization signal 200 is High, the analog switches SW11 and SW22 are ON. In this state, the current $I_{cm1}$ and current $I_{cm2}$ are outputted as the current $I_{ref1}$ and current $I_{ref2}$, respectively. On the other hand, when the synchronization signal 200 is Low, the analog switches SW12 and SW21 are ON. In this state, the current $I_{cm1}$ and current $I_{cm2}$ are outputted as the current $I_{ref2}$ and current $I_{ref1}$, respectively.

Therefore, if the duty ratio of the synchronization signal 200 is set to ½ (50%), the current $I_{cm1}$ and current $I_{cm2}$ are averaged and outputted as the current $I_{ref1}$ and current $I_{ref2}$. Thus, even if there are variations among the currents outputted from a plurality of IC chips, each of the IC chips operates on averaged current in the long run, eliminating variation between reference currents. This makes it possible to obtain uniform emission luminance on the display panel.

The prior art technology shown in FIG. 9 is configured to deliver the same current from one master IC chip (internal current source) to slave IC chips (see FIG. 9). In this conventional configuration, the current variation of the product as a whole depends on the reference current of the master current source. When the variation in the master current is +/−10%, even if the current is delivered to the slaves without error, the overall variation of 10% is not improved. However, according to this embodiment, which changes the IC ship serving as the current source in sequence, even if each current source has a variation of 10%, the variations are averaged and the current variation of the product as a whole is reduced to $10/\sqrt{N}$, which is less than 10%. In other words, whereas the variation in the display luminance of an organic EL panel depends on the variation in the master reference current in the case of the prior art technology, according to the present invention, the variations among the current sources in the IC chips are averaged, and thus the luminance variation of the panel product is improved.

Incidentally, although two IC chips are used in the example described above, even if more than two IC chips are used, similar effects can be obtained by switching among currents in a similar manner. For example, when using three IC chips, the currents supplied to the IC chips can be averaged out if the analog switch shown in FIG. 26 is added to each IC chip and switching control is performed in each IC chip using a synchronization signal with a pulse duty ratio of 1/3 (approximately 33%). Specifically, if the number of IC chips is N, the electrical contact between reference current sources and IC chips can be switched using pulses with a duty ratio of 1/3.

As described above, by switching the correspondence (electrical contact) between reference current sources and IC chips in predetermined cycles, it is possible to average out the currents supplied to the IC chips and reduce variation in output current among IC chips.

Figure 27:
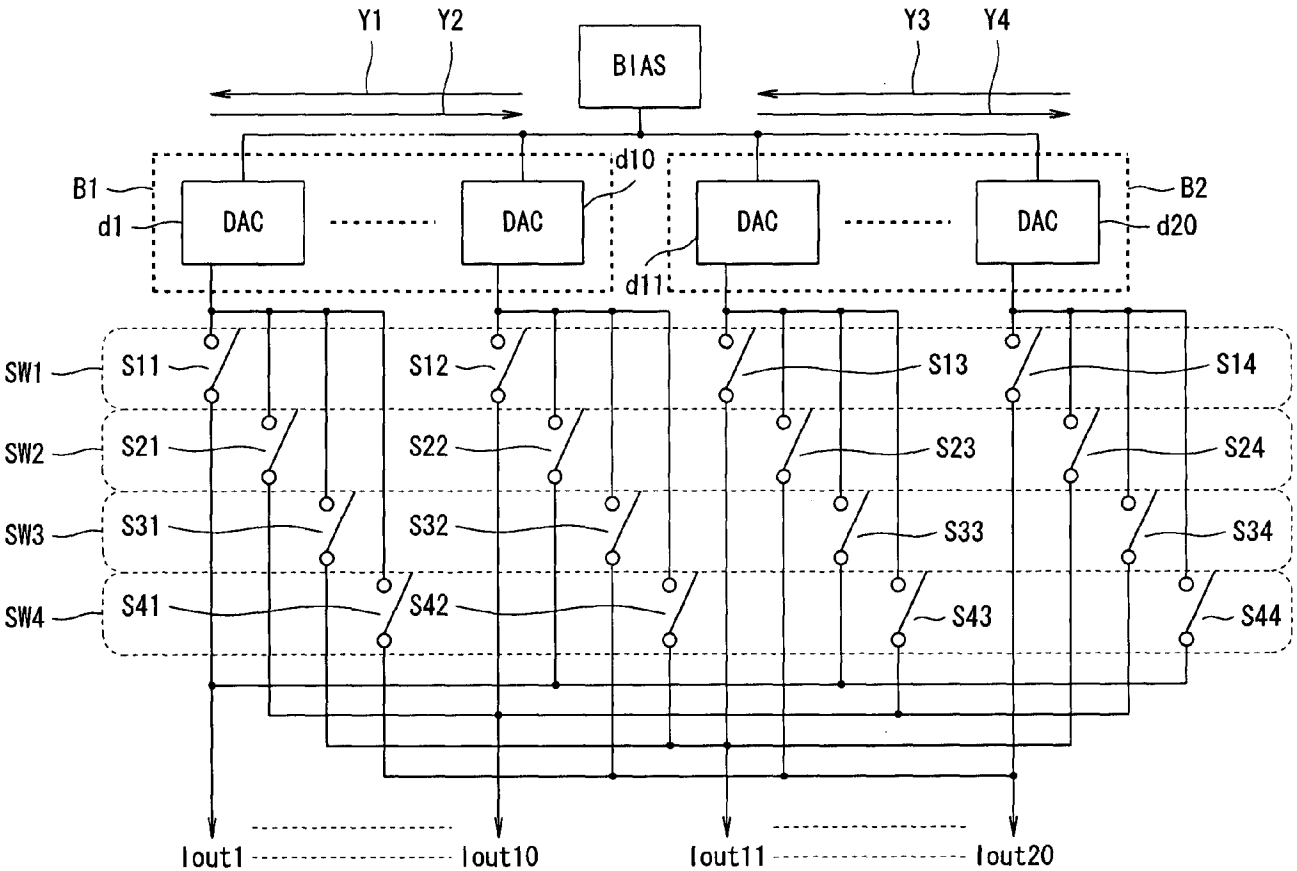
FIG. 27 is a block diagram showing main components of a fifth embodiment of a display panel drive circuit according to the present invention.

FIG. 27 is a block diagram showing main components of a fifth embodiment of a display panel drive circuit according to the present invention. The figure shows a display panel drive circuit which consists of a single BIAS portion and a plurality of DAC portions. The circuit solves problems with conventional circuits by interchanging the output currents from the DAC portions on individual channels among the channels in sequence.

The figure shows a circuit configuration in which the plurality of DAC portions are divided into two blocks. Specifically, 20 DAC portions d1 to d20 are divided into two blocks: block B1 consisting of DAC portions d1 to d10 and block B2 consisting of DAC portions d11 to d20.

Outputs of the ten DAC portions d1 to d10 in the block B1 are derived as output currents $I_{out}$1 to $I_{out}$10 and outputs of the ten DAC portions d11 to d20 in the block B2 are derived as output currents $I_{out}$11 to $I_{out}$20.

In this circuit, switch groups SW1 to SW4 are installed on the outputs of the DAC portions d1 to d20 and are turned on in sequence in such a way that no two switch groups remain ON simultaneously. Consequently, the output currents are averaged, with its correspondence to the DAC portions being switched by the switch groups SW1 to SW4, and are derived as the output currents $I_{out}$1 to $I_{out}$20.

In this example, as shown in FIG. 27 clearly, the correspondence between four DAC portions d1, d10, d11, and d20 and four output currents $I_{out}$1, $I_{out}$10, $I_{out}$11, and $I_{out}$20 are switched by the switches contained in the switch groups SW1 to SW4. The switch group SW1 includes switches SW11, SW12, SW13, and SW14; the switch group SW2 includes switches SW21, SW22, SW23, and SW24; the switch group SW3 includes switches SW31, SW32, SW33, and SW34; and the switch group SW4 includes switches SW41, SW42, SW43, and SW44.

In this example, as indicated by the arrows Y1 and Y2 as well as the arrows Y3 and Y4, the correspondence is switched in both directions in turns. Through the switching of the correspondence, time-division control is performed. In other words, output currents are controlled in such a way as to be averaged over time. This makes it possible to reduce trended variation of output currents in IC chips.

Regarding the DAC portions not shown in FIG. 27, the correspondence between four DAC portions and four output currents are similarly switched by the switches $S_{ij}$ (i=1 to 4; j=1 to 4) contained in the switch groups SW1 to SW4. Specifically, the correspondence between four DAC portions d2, d9, d12, and d19 and four output currents $I_{out}$2, $I_{out}$9, $I_{out}$12, and $I_{out}$19 are switched. Also, the correspondence between four DAC portions d3, d8, d13, and d18 and four output currents $I_{out}$3, $I_{out}$8, $I_{out}$13, and $I_{out}$18 are switched. Also, the correspondence between four DAC portions d4, d7, d14, and d17 and four output currents $I_{out}$4, $I_{out}$7, $I_{out}$14, and $I_{out}$17 are switched. Furthermore, the correspondence between four DAC portions d5, d6, d15, and d16 and four output currents $I_{out}$5, $I_{out}$6, $I_{out}$15, and $I_{out}$16 are switched.

Figure 28:
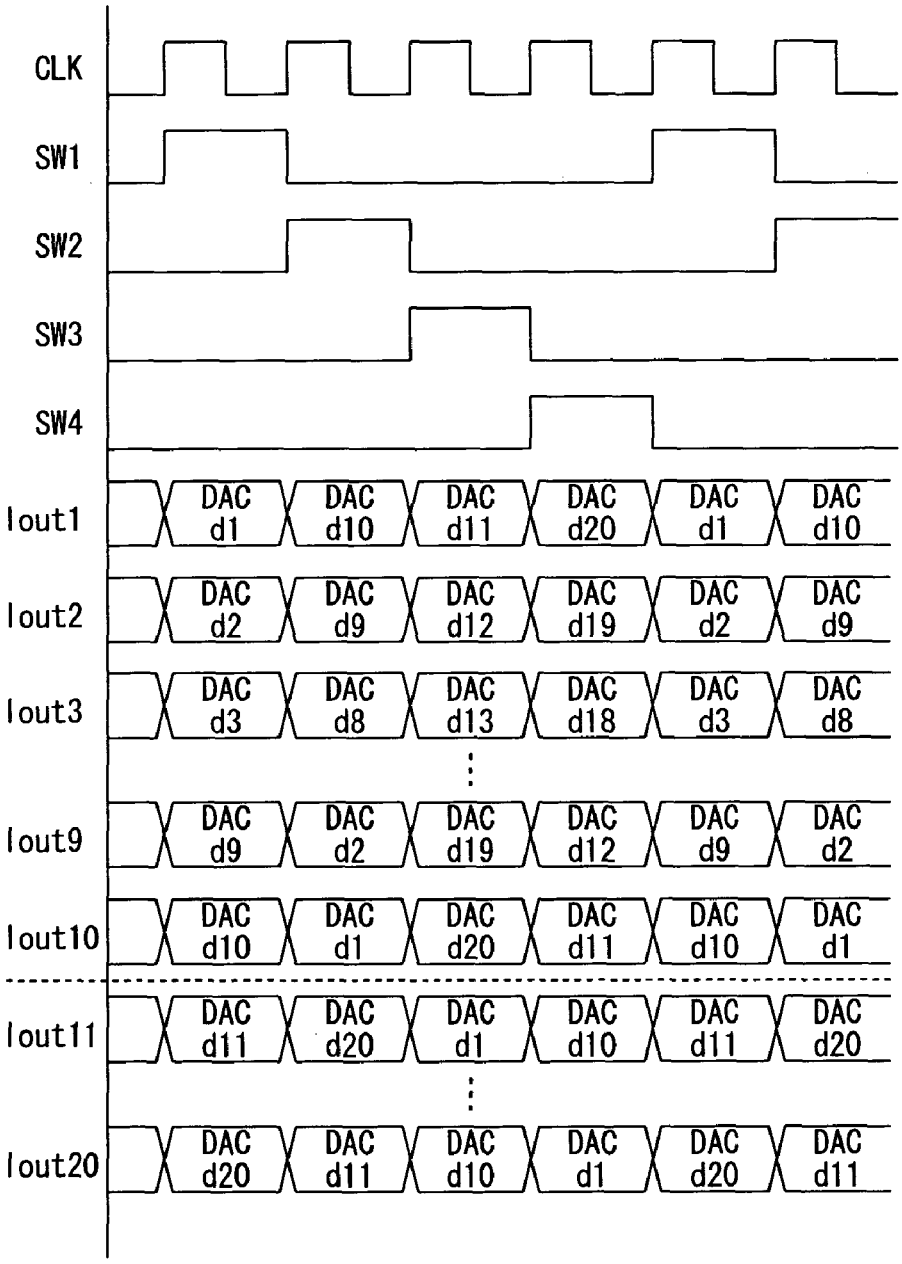
FIG. 28 is a diagram showing an example of timing to switch correspondence between outputs of DAC portions and output currents.

An example of timing to switch correspondence between outputs of DAC portions and output currents is shown in FIG. 28. The figure shows the states of the switch groups SW1 to SW4 as well as the outputs from the DAC portions d1 to d20 which constitute the output currents $I_{out}$1 to $I_{out}$20. Incidentally, reference character CLK in the figure denotes a clock.

Referring to FIG. 28, outputs of the four DAC portions d1, d10, d11, and d20 are averaged in a time-divided manner and synthesized into the output current $I_{out}$1. Also, outputs of the four DAC portions d2, d9, d12, and d19 are averaged in a time-divided manner and derived as the output current $I_{out}$2; and outputs of the four DAC portions d3, d8, d13, and d18 are averaged in a time-divided manner and derived as the output current $I_{out}$3. Regarding the other output currents, outputs of four DAC portions are averaged in a time-divided manner and synthesized into an output current.

Each of the output currents $I_{out}$1, $I_{out}$10, $I_{out}$11, and $I_{out}$20 is synthesized from outputs of the DAC portions d1, d10, d11, and d20. However, when the switch group SW1 is ON, the output current $I_{out}$1 is outputted from the DAC portion d1, the output current $I_{out}$10 is outputted from the DAC portion d10, the output current $I_{out}$11 is outputted from the DAC portion d11, and the output current $I_{out}$20 is outputted from the DAC portion d20. Similarly, when the switch group SW2 is ON, the output current $I_{out}$1 is outputted from the DAC portion d10, the output current $I_{out}$10 is outputted from the DAC portion d1, the output current $I_{out}$11 is outputted from the DAC portion d20, and the output current $I_{out}$20 is outputted from the DAC portion d11; when the switch group SW3 is ON, the output current $I_{out}$1 is outputted from the DAC portion d11, the output current $I_{out}$10 is outputted from the DAC portion d20, the output current $I_{out}$11 is outputted from the DAC portion d1, and the output current $I_{out}$20 is outputted from the DAC portion d10; when the switch group SW4 is ON, the output current $I_{out}$1 is outputted from the DAC portion d20, the output current $I_{out}$10 is outputted from the DAC portion d11, the output current $I_{out}$11 is outputted from the DAC portion d10, and the output current $I_{out}$20 is outputted from the DAC portion d1; and so forth.

Other output currents are also synthesized from outputs of DAC portions in a time-divided manner through the operation of the switch groups. Thus, by operating a plurality of switches provided corresponding to a plurality of DAC portions, it is possible to reduce the above-described variation using a simple configuration.

Incidentally, the control signal used to switch the correspondence between DAC portions and output currents according to the timing chart such as the one shown in FIG. 28 is generated by a counter circuit or the like. For example, an N-stage ring counter is used (N=4 in the above example). An N-stage ring counter can be configured, for example, by using N stages of shift resisters connected in series and connecting the last-stage output to the first-stage input.

Figure 29:
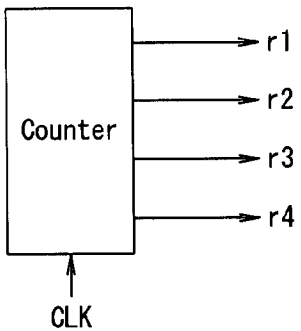
FIG. 29(*a*) is a diagram showing a four-stage ring counter.
Figure 29:
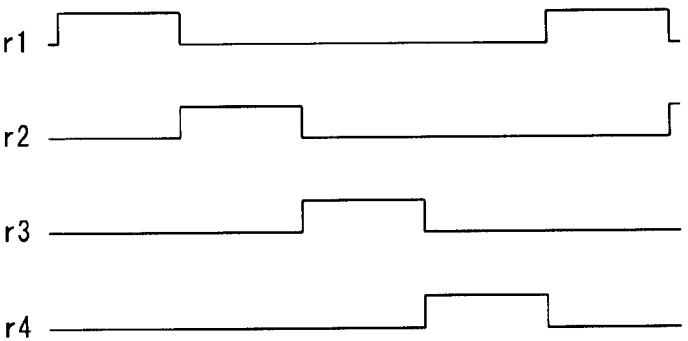
Figure 29:
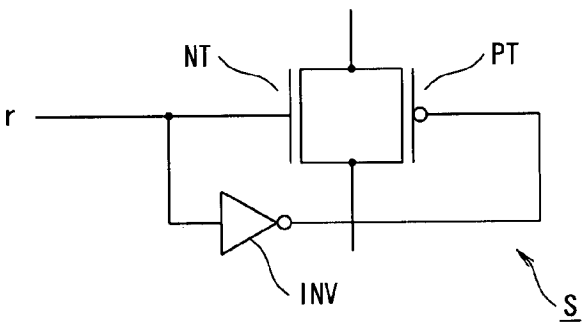

When an N-stage ring counter is used, waveforms of control signals r1 to r4 outputted from the ring counter shown in FIG. 29(*a*) change in such a way that the periods in which the signals are High shift in sequence as shown in FIG. 29(*b*). The control signals r1 to r4 whose waveforms change in this way are supplied to the switches in the switch groups SW1 to SW4.

Destinations of the control signals r1 to r4 are shown in FIG. 29(*c*). As shown in the figure, the control signal r1 is supplied to switches s11, s12, s13, and s14 in FIG. 27. Also, the control signal r2 is supplied to switches s21, s22, s23, and s24. Similarly, the control signal r3 is supplied to switches s31, s32, s33, and s34 while the control signal r4 is supplied to switches s41, s42, s43, and s44. As the control signals r1 to r4 are supplied to the switches in the switch groups SW1 to SW4, the operations shown in FIG. 28 can be performed.

Incidentally, each of the switches in the switch groups SW1 to SW4 is configured, for example, as shown in FIG. 29(*d*). In the figure, the switch consists of an NMOS (N-channel Metal oxide Semiconductor) transistor NT and PMOS (P-channel Metal oxide Semiconductor) transistor PT with the source terminals connected with each other and the drain terminals connected with each other. A control signal r is applied to the gate terminal of the NMOS transistor NT directly while it is applied to the gate terminal of the PMOS transistor PT after being inverted by an inverter INV.

Figure 30:
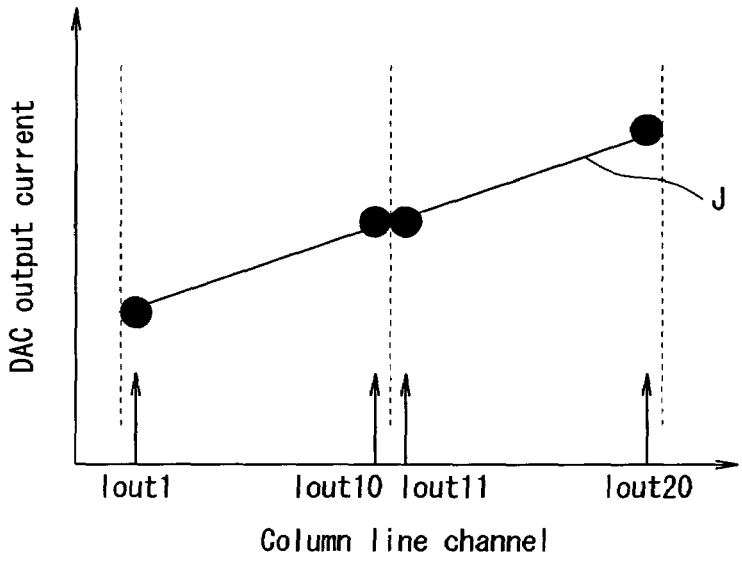
FIG. 30 is a diagram showing a trended variation of output currents in an IC chip in a circuit in which switching control is not performed.

Now consider a conventional circuit in which the correspondence described above is not switched and trended variation of output currents in IC chips has characteristics shown in FIG. 30. The figure shows output current of DAC portions versus column line channels. In the figure, the location of a black circle ● moves upward as the column line channel changes from out put current $I_{out}$1 through output current $I_{out}$10 and output current $I_{out}$11 to output current $I_{out}$20. Thus, as indicated by the solid line J in the figure, the output current of DAC portions tends to increase gradually against column line channels.

When the circuit configuration of this embodiment is adopted, this characteristic takes the following form. Taking the output current $I_{out}$1 as an example, the DAC portion d1, DAC portion d10, DAC portion d11, and DAC portion d20 are used to derive the output current $I_{out}$1. Specifically, the outputs from the DAC portions are averaged in a time-divided manner to produce the output current $I_{out}$1. In other words, a current is derived which is equivalent to (output of DAC portion d1+output of DAC portion d10+output of DAC portion d11+output of DAC portion d20)/4

Figure 31:
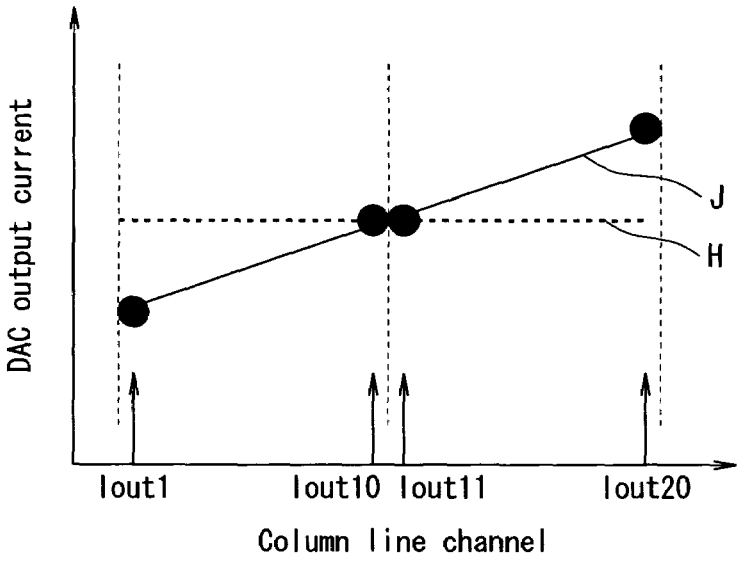
FIG. 31 is a diagram showing how the trended variation of output currents in the IC chip is reduced by switching control.

As a result, the output currents indicated by the solid line J in FIG. 31 are averaged as indicated by the broken line H, reducing the trended variation of the output currents in IC chips. Other output currents can be averaged in a similar manner, reducing the trended variation of the output currents in IC chips.

This circuit can also reduce random current variation inherent to the DAC portions. This will be described below.

Let ΔI denote the random current variation of the DAC portions. ΔI is the same as the current variation of conventional DAC portions. Also, let $\Delta I_1$ denote the random current variation of the DAC portions connected to the switch group SW1, let $\Delta I_2$ denote the random current variation of the DAC portions connected to the switch group SW2, let $\Delta I_3$ denote the random current variation of the DAC portions connected to the switch group SW3, and let $\Delta I_4$ denote the random current variation of the DAC portions connected to the switch group SW4. Then, the average variation is as follows:

$$\text{Average variation}=\tfrac{1}{4}\times\sqrt{(\Delta I_1^2+\Delta I_2^2+\Delta I_3^2+\Delta I_4^2)}$$

If it is assumed that $\Delta I_1$, $\Delta I_2$, $\Delta I_3$, and $\Delta I_4$ are equal to ΔI, $$\text{Average variation}=1\sqrt{4}\times\Delta I$$

Thus, the configuration of this circuit makes the amount of current variation smaller than that of the current variation 66 I of conventional DAC portions.

Figure 32:
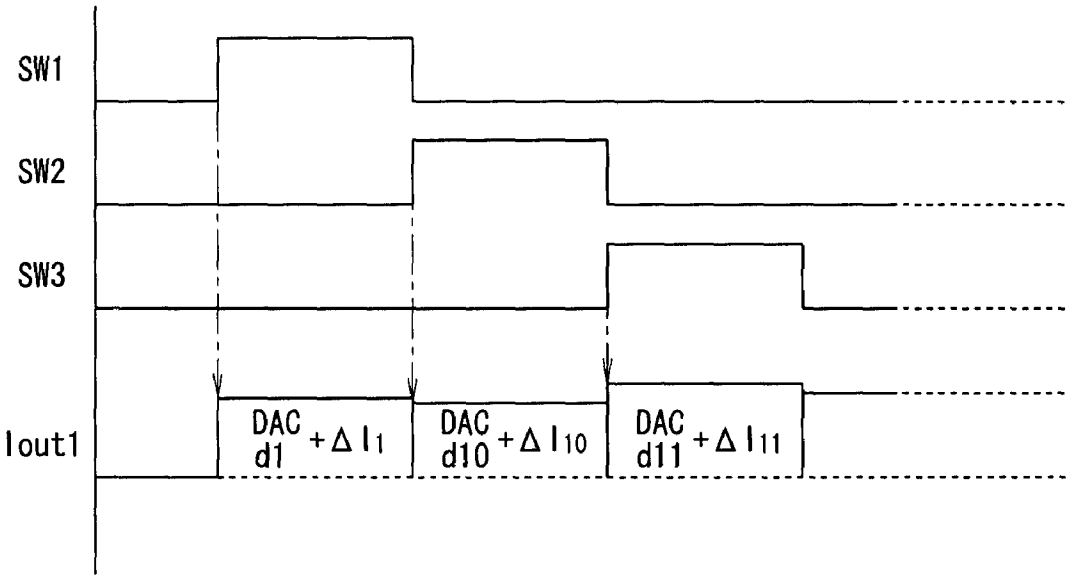
FIG. 32 is a timing chart which takes into consideration random current variation in DAC portions.

FIG. 32 shows a timing chart which takes into consideration random current variation in DAC portions. The figure shows relationship between the output current $I_{out}$1 and switch groups as a representative example.

As shown in the figure, when the switch group SW1 is ON, the output current $I_{out}$1 equals the output of the DAC portion d1 plus the current variation $\Delta I_1$. Also, when the switch group SW2 is ON, the output current $I_{out}$1 equals the output of the DAC portion d10 plus the current variation $\Delta I_{10}$. Similarly, for a switch group which is ON, the output current $I_{out}$1 equals the output of the DAC portion dk (k=1, 10, 11, 20, etc.) plus the current variation $\Delta I_k$. The other currents are also calculated by adding current variation to the output of the DAC portions. Thus, even if there are random current variations, the amount of current variation can be reduced by averaging the outputs in a time-divided manner as described above.

Incidentally, although in the configuration example shown in FIG. 27, the plurality of DAC portions are divided into two blocks, the number of blocks is not limited to two. Besides, the configuration requires twice as many switch groups as there are blocks of DAC portions.

Also, the bit count used by the DAC portions is not limited to the one described above. The number of channels in the DAC portions is not limited to the one used in the above example either. Regarding the circuit configuration of the DAC portions, either PMOS transistors or NMOS transistors may be used.

Also, although the pixel elements composing the display panel are EL elements in the example described above, it is obvious that the present invention also applies to cases in which other elements are used.

Figure 33:
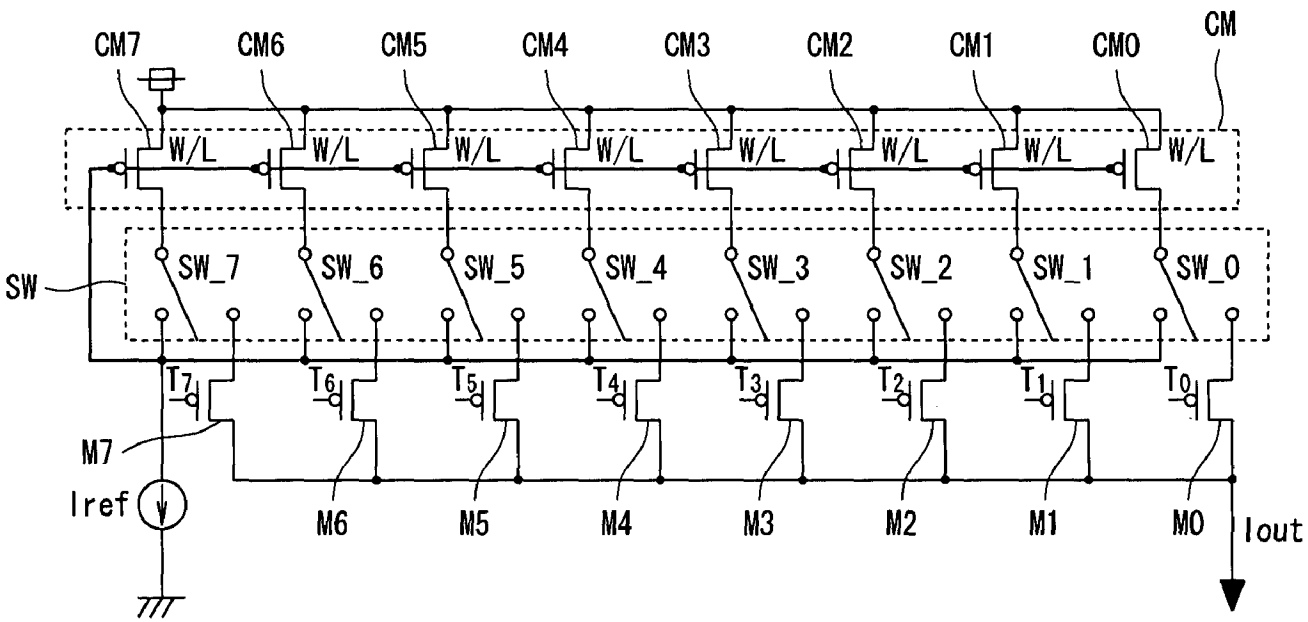
FIG. 33 is a block diagram showing a sixth embodiment of a display panel drive circuit according to the present invention.

FIG. 33 is a block diagram showing main components of a sixth embodiment of a display panel drive circuit according to the present invention. The figure shows a configuration example in which a 3-bit DAC circuit is used. In such a 3-bit DAC circuit, a current mirror circuit requires one MOS transistor (hereinafter referred to as a MOSTr) in a BIAS portion and seven (4+2+1) MOSTrs in a DAC portion for a total of eight. Thus, the display panel drive circuit shown in FIG. 33 comprises eight MOSTrs M0 to M7, a switch circuit SW consisting of switches SW0 to SW7 corresponding to the MOSTrs M0 to M7, and a current mirror circuit CM consisting of eight MOSTrs CM0 to CM7.

Control signals T0 to T7 are supplied to gate terminals of the eight MOSTrs M0 to M7, respectively, as described below. Thus, the MOSTrs M0 to M7 are turned on and off by the respective control signals T0 to T7.

Each of the switches SW0 to SW7 which compose the switch circuit SW operates to electrically connect respective one of the eight MOSTrs CM0 to CM7 composing the current mirror circuit CM with either the reference current source $I_{ref}$ or the respective one of the MOSTrs M0 to M7. When any of the MOSTrs CM0 to CM7 composing the current mirror circuit CM is connected to the respective one of the MOSTrs M0 to M7, an output current $I_{out}$ is supplied to a display panel not shown. Specifically, the MOSTrs CM0 to CM7 composing the current mirror circuit CM operate as a mirror source when electrically connected to the reference current source $I_{ref}$ by the operation of the switches SW0 to SW7, and operate as a DAC circuit for generating the output current $I_{out}$, i.e., a drive signal to be supplied to pixels, when connected to the corresponding MOSTrs M0 to M7. Incidentally, it is assumed that the eight MOSTrs CM0 to CM7 composing the current mirror circuit CM have the same channel width to channel length ratio W/L.

With this configuration, the circuit uses all the eight MOSTrs M0 to M7 as the BIAS portion with a major current variation by switching among them in sequence with the switches SW0 to SW7. By averaging the current variations of all the eight MOSTrs M0 to M7 over time in this way, it is possible to reduce the current variation of the entire DAC circuit.

Figure 34:
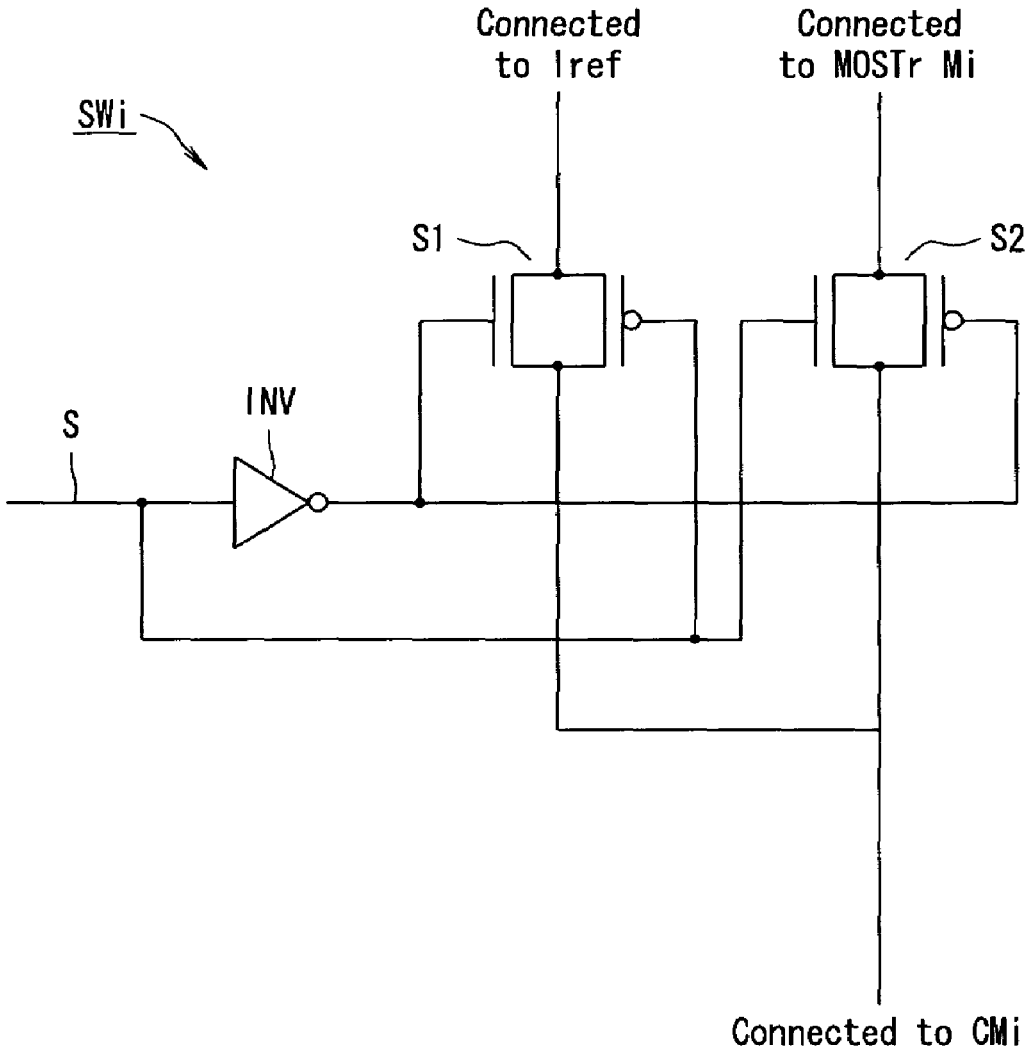
FIG. 34 is a diagram showing a configuration example of the switches which compose the switching circuit shown in FIG. 33.

Each of the switches SWi (i=0 to 7, the same applies hereinafter) composing the switch circuit SW can be configured, for example, as shown in FIG. 34. In other words, it comprises analog switches S1 and S2 as shown in the figure. Each of the analog switches S1 and S2 consists of a p-channel MOSTr and n-channel MOSTr which share both the source and drain. The analog switch S1 is connected to the reference current source $I_{ref}$ while the analog switch S2 is connected to a MOSTr Mi.

The p-channel MOSTr constituting the analog switch S1 is fed a control signal S as it is while the n-channel MOSTr is fed the control signal S inverted by an inverter INV. On the other hand, p-channel MOSTr constituting the analog switch S2 is fed the control signal S inverted by the inverter INV while the n-channel MOSTr is fed a control signal S as it is. With this circuit connection, when the control signal S is Low, the analog switch S1 is ON (conducting) and the analog switch S2 is OFF (non-conducting). On the other hand, when the control signal S is High, the analog switch S2 is ON (conducting) and the analog switch S1 is OFF (non-conducting).

Thus, depending on the state of the control signal S, either the MOSTrs Mi which correspond to the switches SWi or the reference current source $I_{ref}$ is connected electrically to the MOSTrs CMi (i=0 to 7, the same applies hereinafter) which compose the current mirror circuit CM.

The control signal S supplied to the switches SWi is generated by a counter circuit or the like.

Figure 35:
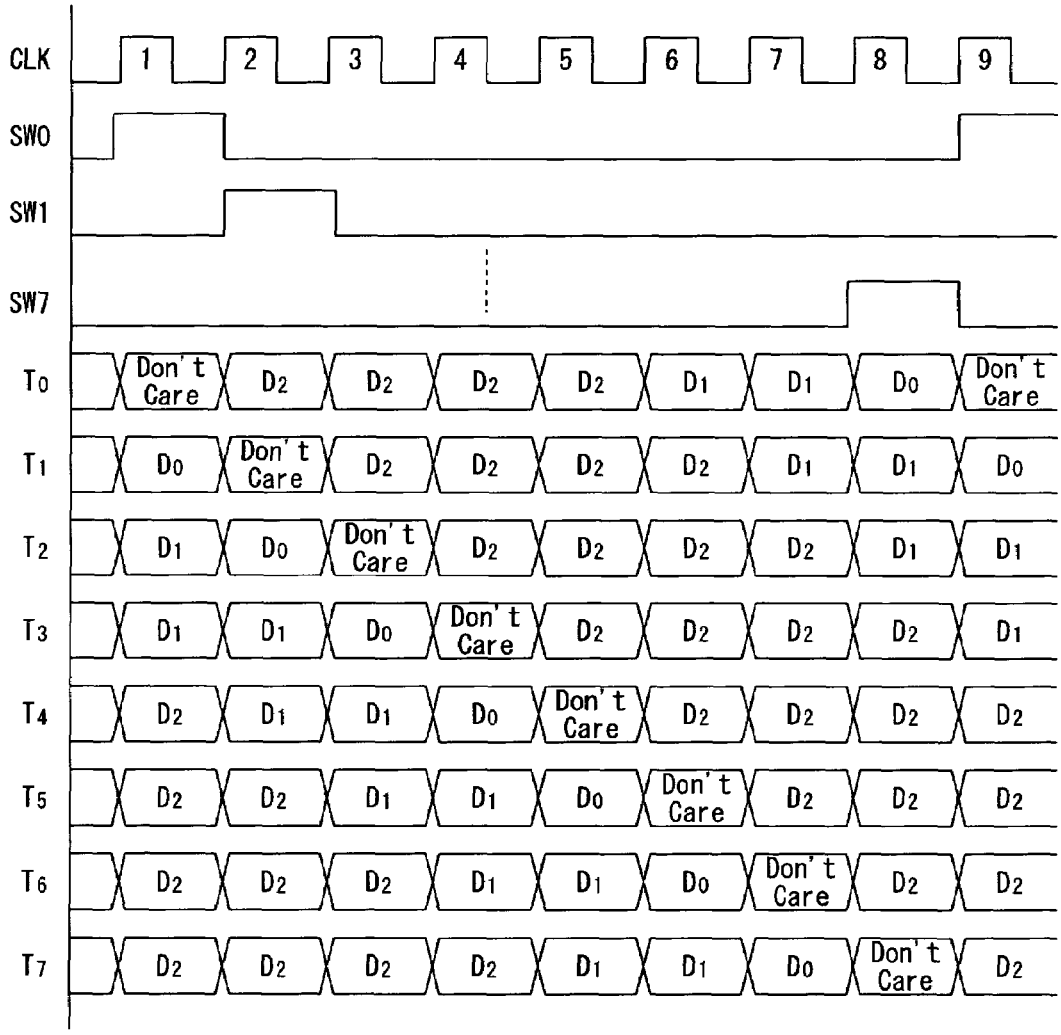
FIG. 35 is a timing chart showing a clock, ON/OFF states of the switches which compose the switching circuit, and control signals.

Returning to FIG. 33, the control signals T0 to T7 shown in the figure are generated being timed as shown in FIG. 35 using the control signal (the control signal S described above) supplied to the switches SWi composing the switch circuit SW and data signals D2 to D0 (3-bit in this example) from the DAC portion.

FIG. 35 is a timing chart showing a clock CLK, the ON/OFF states of the switches SWi which compose the switching circuit SW, and control signals T0 to T7. The switch SWi is ON (conducting) when the waveform in the figure is High, and is OFF (non-conducting) when the waveform is Low. As shown in the figure, when the switch SWi is conducting, the corresponding MOSTr Mi is turned on and off by the control signal Ti. At this time, 3-bit pixel data D0 to D2 are supplied as control signals to the MOSTrs M0 to M7 except the MOSTr Mi which corresponds to the switch SWi.

For example, when the switch SW0 is conducting, the MOSTr M0 which corresponds to the switch SW0 is turned on and off by the control signal T0. The MOSTrs M1 to M7 other than the MOSTr M0 which corresponds to the switch SW0 are supplied with the 3-bit pixel data D0 to D2 as the control signals T1 to T7. The MOSTr M1 is supplied with the pixel data D0 as the control signal T1. The MOSTrs M2 and M3 are supplied with the pixel data D1 as the control signals T2 and T3. The MOSTrs M4 to M7 are supplied with the pixel data D2 as the control signals T4 to T7.

Also, when the switch SW1 is conducting, the MOSTr M1 which corresponds to the switch SW1 is turned on and off by the control signal T1. The MOSTrs M2 to M7 and M0 other than the MOSTr M1 which corresponds to the switch SW1 are supplied with the 3-bit pixel data D0 to D2 as control signals T2 to T7 and T0. The MOSTr M2 is supplied with the pixel data D0 as the control signal T2. The MOSTrs M3 and M4 are supplied with the pixel data D1 as the control signals T3 and T4. The MOSTrs M5 to M7 and M0 are supplied with the pixel data D2 as the control signals T5 to T7 and T0.

Similarly, the MOSTr Mi which corresponds to the conducting switch SWi is turned on and off by the control signal Ti. The MOSTrs other than the MOSTr Mi which corresponds to the conducting switch SWi are supplied with the 3-bit pixel data D0 to D2 as control signals. In other words, at least one of n transistors is connected directly to the reference current source to supply a bias signal and the other transistors operate as a DAC circuit to generate drive signals to be supplied to the pixels using the bias signal, wherein the transistor which supplies the bias signal is changed in sequence in a time-divided manner.

In this way, the transistor which operates as the BIAS portion is changed in sequence in such a way that all the eight MOSTrs M0 to M7 are assigned in turns to the BIAS portion with a major current variation.

Figure 36:
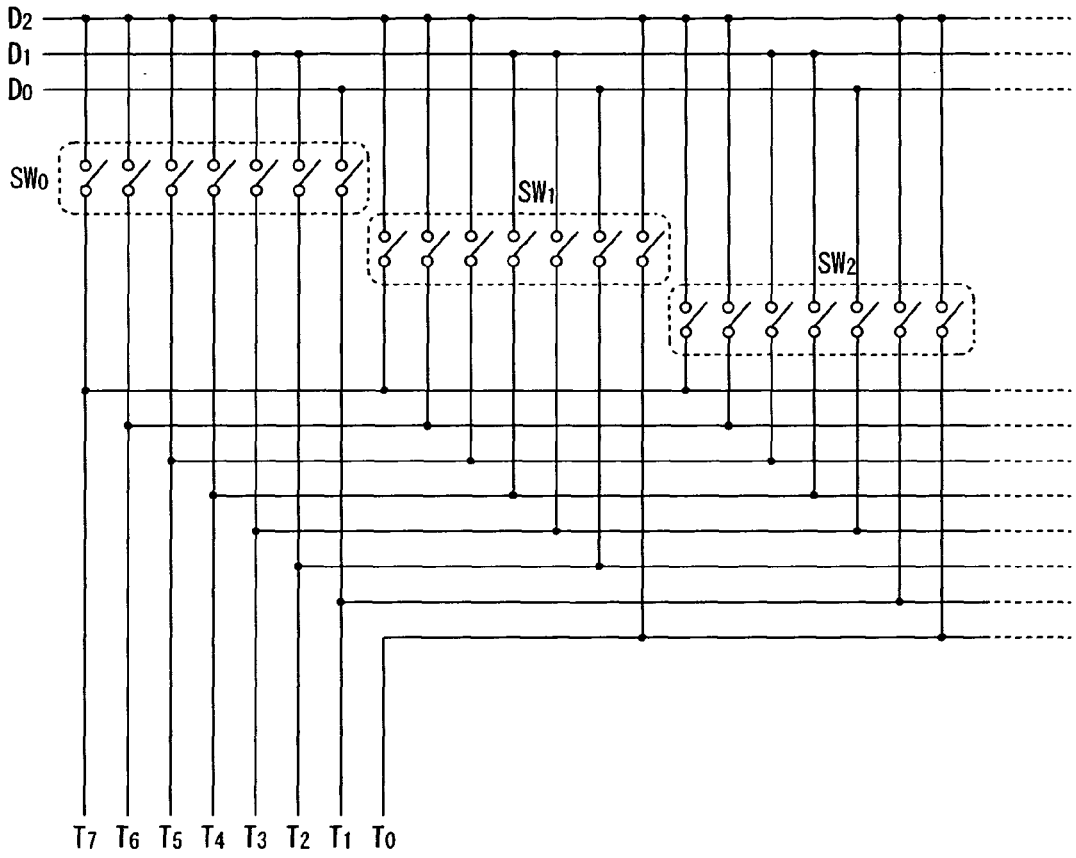
FIG. 36 is a diagram showing a configuration example of a circuit which generates control signals to be supplied to a gate terminal of a MOSTr shown in FIG. 33.

A configuration example of a circuit which generates the control signals T0 to T7 supplied to the gate terminals of the MOSTrs M0 to M7 in FIG. 33 will be described with reference to FIG. 36. Switches SW0, SW1, SW3, . . . which are fed the 3-bit data signals D2 to D0 are provided in the circuit shown in FIG. 36. The switch SW0 generates the control signals other than the control signal T0 using the 3-bit data signals D2 to D0. Also, the switch SW1 generates the control signals other than the control signal T1 using the 3-bit data signals D2 to D0. Also, the switch SW2 generates the control signals other than the control signal T2 using the 3-bit data signals D2 to D0. Similarly, the switch SWk (k=0 to 7) generates the control signals other than the control signal Tk using the 3-bit data signals D2 to D0. This configuration makes it possible to generate the control signal T0 to T7 shown in FIG. 35.

Let ΔI0 denote the current variation which occurs when the MOSTr CM0 used for the current mirror and corresponding to the SW0 is used as the BIAS portion and let ΔI1 denote the current variation which occurs when the MOSTr CM1 used for the current mirror and corresponding to the SW1 is used as the BIAS portion. Similarly, let ΔI2 denote the current variation which occurs when the MOSTr CM2 is used as the BIAS portion, let 66 I3 denote the current variation which occurs when the MOSTr CM3 is used as the BIAS portion, let ΔI4 denote the current variation which occurs when the MOSTr CM4 is used as the BIAS portion, let ΔI5 denote the current variation which occurs when the MOSTr CM5 is used as the BIAS portion, let ΔI6 denote the current variation which occurs when the MOSTr CM6 is used as the BIAS portion, and let ΔI7 denote the current variation which occurs when the MOSTr CM7 is used as the BIAS portion. Then, the average variation is as follows:

$$\text{Average variation}=1/8\times\sqrt{(\Delta I_0^2+\Delta I_1^2 \ldots +\Delta I_7^2)}$$

If it is assumed that $\Delta I_0$, $\Delta I_1$, . . . , and $\Delta I_7$ are equal to ΔI, $$\text{Average variation}=1\sqrt{8}\times\Delta I$$

Thus, the current variation ΔI is smaller than that of conventional circuits.

Figure 37:
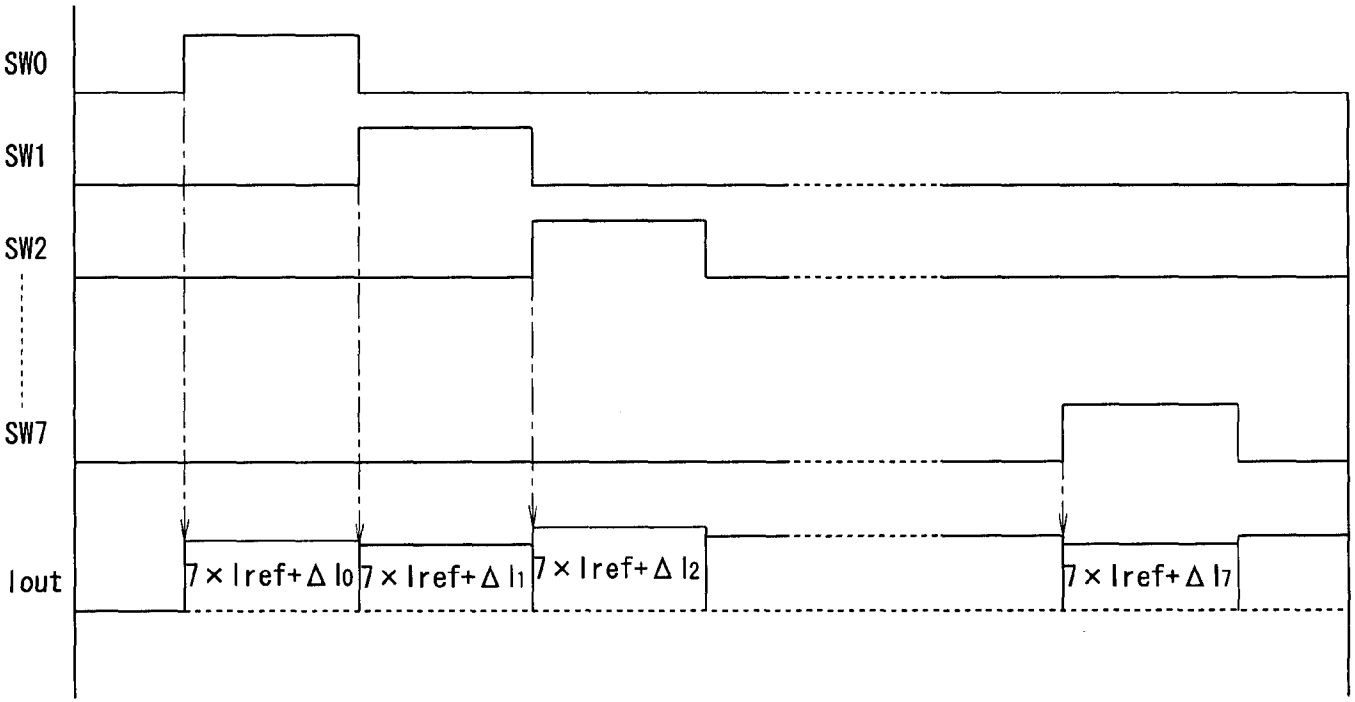
FIG. 37 is a timing chart showing ON/OFF states of switches vs. output currents.

A timing chart which shows relationship between the ON/OFF states of the switches SWi and the output current $I_{out}$ when all the data D0, D1, and D2 in the DAC portion are High (or in full code) is shown in FIG. 37. As shown in the figure, the output current $I_{out}$ is given by $$I_{out}=7\times I_{ref}+\Delta I_i$$

Thus, it contains a current variation of $\Delta I_i$.

In the case of an n-bit DAC circuit, the number of MOSTrs in the DAC portion is given by $$2^{n-1}+2^{n-2}+ \ldots +2^0=\Sigma 2^i$$

where Σ is the sum total of i=0 to n−1 (the same applies hereinafter). Thus, the total of MOSTrs in the DAC portion is $\Sigma 2^i$.

Hence, the average value of current variations is given by $$(\Sigma 2^{i+1})^{-1/2}\times\Delta I$$

In this way, an accurate DAC circuit which can reduce variations between adjacent channels can be implemented. Incidentally, it is obvious that variations between adjacent channels can be reduced regardless of the bit count used by the DAC portion.

Although a PMOS DAC circuit has been cited as an example, it is obvious that the present invention also applies to NMOS DAC circuits.

Also, although the pixel elements composing the display panel are EL elements in the example described above, it is obvious that the present invention also applies to cases in which other elements are used.

INDUSTRIAL APPLICABILITY

According to the first embodiment described above, when an anode line drive circuit is constructed from a plurality of IC chips, dummy drive output and proper drive output of the adjoining IC chip are switched in predetermined cycles and supplied to a drive line to reduce luminance differences in display areas caused by differences in current driving capacity among the IC chips and prevent degradation of image quality.

According to the second embodiment described above, correspondence between a plurality of IC chips and drive current sources are switched in predetermined cycles, which has the effect of reducing current variation in a current mirror. Also, variation in reference current among the plurality of IC chips is eliminated, providing uniform emission luminance on a display panel.

According to the third embodiment described above, a transistor which serves as a reference current source is changed periodically, reducing current variation in a current mirror and eliminating variation in reference current among a plurality of IC chips, thereby providing uniform emission luminance on a display panel.

According to the fourth embodiment described above, since an averaged current is supplied to a plurality of IC chips instead of the same current, even if there are variations among currents outputted from the IC chips, each of the IC chips operates on the averaged current in the long run, eliminating variation among reference currents. This makes it possible to obtain uniform emission luminance on a display panel.

According to the fifth embodiment described above, by switching the correspondence between a plurality of DAC portions and output currents in sequence in a time-divided manner, it is possible to reduce trended variation of the output currents in IC chips and decrease random current variations.

According to the sixth embodiment described above, a transistor which supplies a bias signal is changed in sequence in a time-divided manner and other transistors operate as a circuit to generate drive signals to be supplied to pixels using the bias signal, making it possible to implement an accurate DAC circuit and reduce variations between adjacent channels.

The invention claimed is:

1. A display panel drive circuit which supplies current to a plurality of IC chips, including at least a first IC chip and a second IC chip, the display panel drive circuit comprising:

a first anode line drive circuit on the first IC chip, the first anode line drive circuit comprising:

a first current source which outputs a first reference current for a first current mirror;

a first internal circuit which generates drive current for driving a first display panel using a second current mirror circuit; and a first switching circuit that outputs a first output current to the first internal circuit; and a second anode line drive circuit, comprising:

a second current source which outputs a second reference current for the first current mirror; and a second internal circuit which generates drive current for driving a second display panel using a third current mirror;

a second switching circuit that outputs a second output current to the second internal circuit;

wherein the first and second switching circuits:

receive the first reference current and the second reference current, and respectively generate the first and second output currents by switching the first switching circuit and the second switching circuit to receive either the first or second reference currents in accordance with a predetermined duty ratio.

2. The display panel drive circuit according to claim 1, wherein the duty ratio is 1:2 (50%).

3. The display panel drive circuit according to claim 1, wherein the plurality of IC chips are three or more in number; and the correspondence between the first reference current and the third reference current is switched in rotation in predetermined cycles to the plurality of internal circuits.

4. The display panel drive circuit according to claim 1, wherein the first and second display panels are composed of a plurality of electroluminescent elements driven by drive currents produced by the respective IC chips.

5. A display panel drive circuit, comprising:

a plurality a IC chips, including at least a first IC chip that supplies a first drive output of a first group of channels, and a second IC chip that supplies a second drive output of a second group of channels, the first drive output and the second drive output being supplied for driving a plurality of pixel elements which comprise a display panel;

the first IC chip further comprising a first switching circuit that:

receives a first channel drive output corresponding to one of the channels, from the first group of channels, and a second dummy drive output from the second IC chip which does not belong to the second IC drive output, and supplies the first channel drive output and the second dummy drive to the first IC drive output based on a predetermined switching ratio; and the second IC chip further comprising a second switching circuit that:

receives a second channel drive output corresponding to one of the channels, from the second group of channels, and a first dummy drive output from the first IC chip which does not belong to the first IC drive output, and supplies the second channel drive output and the first dummy drive to the second IC drive output by switching in synchronization with the first switching circuit.

6. The display panel drive circuit according to claim 5, wherein the first IC chip and the second IC chip are coupled together.

7. The display panel drive circuit according to any one of claims 5 or 6, wherein the first dummy drive output and the second dummy drive output are provided with an adjoining channel.

8. The display panel drive circuit according to claim 5, wherein the predetermined switching ratio is selected from a range 1:1 to 2:1.

9. The display panel drive circuit according to claim 5, wherein the switching circuits are formed in respective ones of the IC chips.

10. A display panel drive circuit implemented in a plurality of IC chips, comprising:

a reference current generating circuit which uses a current mirror to generate a plurality of reference currents, including a first reference current and a second reference current; and a plurality of cathode line drive circuits, including a first cathode line drive circuit and a second cathode line drive circuit, the plurality of cathode line drive circuits implementing current mirror circuits to drive a plurality of pixel elements of a display panel, wherein the reference current generating circuit further comprises switching means for:

switching correspondence between the plurality of reference currents and supplying a plurality of output currents, including a first output current and a second output current, to respective ones of the plurality of cathode line drive circuits by alternately supplying either the first reference current or the second reference current as the respective output current based on a predetermined synchronizing switching ratio.

11. The display panel drive circuit according to claim 10, wherein the switching means switches electrical connection between the plurality of reference current to the plurality of cathode line drive circuits using pulses with the predetermined synchronizing switching ratio of 1/N, where N is the number of IC chips.

12. The display panel drive circuit according to claim 10 or 11, wherein the display panel is composed of plurality of electroluminescent elements driven by the drive outputs produced by the respective IC chips.

13. A display panel drive circuit comprising:

a plurality of digital-to-analog converter portions;

a single biasing portion which supplies bias signals to the digital-to-analog converter portions, and supplies a plurality of output currents, derived from the plurality of digital-to-analog converter portions, to pixels to drive a display panel; and switching means having a plurality of switches for:

receiving the plurality of output currents from the plurality of digital-to-analog converter portions, and outputting the output currents by selecting the plurality of output currents based on a predetermined synchronizing switching ratio.

* * * * *